US011164535B2

(12) United States Patent
Hou et al.

(10) Patent No.: US 11,164,535 B2
(45) Date of Patent: Nov. 2, 2021

(54) DISPLAY CONTROL METHOD AND APPARATUS, AND DISPLAY APPARATUS FOR IMPROVING PICTURE QUALITY

(71) Applicants: Beijing BOE Display Technology Co., Ltd., Beijing (CN); BOE Technology Group Co., Ltd., Beijing (CN)

(72) Inventors: Qingna Hou, Beijing (CN); Weifan Yang, Beijing (CN); Na Li, Beijing (CN)

(73) Assignees: BEIJING BOE DISPLAY TECHNOLOGY CO., LTD., Beijing (CN); BOE TECHNOLOGY GROUP CO., LTD., Beijng (CN)

( * ) Notice: Subject to any disclaimer, the term of this patent is extended or adjusted under 35 U.S.C. 154(b) by 0 days.

(21) Appl. No.: 16/642,637

(22) PCT Filed: Jun. 11, 2019

(86) PCT No.: PCT/CN2019/090693

§ 371 (c)(1),
(2) Date: Feb. 27, 2020

(87) PCT Pub. No.: WO2020/001266

PCT Pub. Date: Jan. 2, 2020

(65) Prior Publication Data

US 2021/0158768 A1 May 27, 2021

(30) Foreign Application Priority Data

Jun. 26, 2018 (CN) ..... 201810667491.3

(51) Int. Cl.
*G09G 3/36* (2006.01)

(52) U.S. Cl.
CPC ..... *G09G 3/3614* (2013.01); *G09G 3/3688* (2013.01)

(58) Field of Classification Search
CPC ..... G09G 3/3614; G09G 3/3688
See application file for complete search history.

(56) References Cited

U.S. PATENT DOCUMENTS

2009/0058786 A1* 3/2009 Ku ..... G09G 3/3685 345/96
2009/0185082 A1 7/2009 Hashimoto
(Continued)

FOREIGN PATENT DOCUMENTS

CN 101577091 A 11/2009
CN 101901579 A 12/2010
(Continued)

OTHER PUBLICATIONS

International search report of PCT application No. PCT/CN2019/090693 dated Sep. 11, 2019.

*Primary Examiner* — Kwang-Su Yang
(74) *Attorney, Agent, or Firm* — Fay Sharpe LLP

(57) ABSTRACT

Provided are a display control method and apparatus, a display apparatus, a storage medium, and a computer device. The display control method includes: detecting a picture frame to be output; and controlling a plurality of data lines to output, in a first mode, data signals for displaying the picture frame to be output in in response to detection that the picture frame to be output comprises a reference picture, wherein a signal polarity sequence in the first mode is different from a signal polarity sequence in a second mode, the second mode is an output mode of the plurality of data lines when the picture frame to be output does not comprise a reference picture, the signal polarity sequence is a sequence of polarities of data signals provided by all of the plurality of data lines according to an arrangement order of the plurality of data lines in a display apparatus. The present disclosure solves or improves various display defects caused
(Continued)

by local or overall changes in the common voltage value by changing the output mode of data lines.

19 Claims, 17 Drawing Sheets

(56) References Cited

U.S. PATENT DOCUMENTS

| | | | | |
|---|---|---|---|---|
| 2010/0013858 | A1* | 1/2010 | Tamura | H04N 5/23293 345/630 |
| 2011/0234561 | A1* | 9/2011 | Tzeng | G09G 3/3614 345/209 |
| 2013/0241960 | A1* | 9/2013 | Xu | G09G 3/3614 345/690 |
| 2014/0036184 | A1 | 2/2014 | Xu et al. | |
| 2014/0267212 | A1* | 9/2014 | Li | G09G 3/3614 345/212 |
| 2017/0287419 | A1* | 10/2017 | Noichi | G09G 3/3688 |

FOREIGN PATENT DOCUMENTS

| | | | |
|---|---|---|---|
| CN | 102237058 | A | 11/2011 |
| CN | 102789771 | A | 11/2012 |
| CN | 105096873 | A | 11/2015 |
| KR | 20060087669 | A | 8/2006 |

* cited by examiner

DISPLAY CONTROL METHOD AND APPARATUS, AND DISPLAY APPARATUS FOR IMPROVING PICTURE QUALITY

This application claims priority to Chinese Patent Application No. 201810667491.3, filed on Jun. 26, 2018 and entitled "Display Control Method and Apparatus, Display Apparatus, Storage Medium and Computer Device", the overall contents of which are incorporated herein by reference.

TECHNICAL FIELD

The present disclosure relates to the field of display technology, and in particular, to a display control method and apparatus, a display apparatus, a storage medium, and a computer device.

BACKGROUND

Thin film transistor liquid crystal displays (TFT-LCD) are widely used in electronic products, such as televisions, mobile phones, displays, and the like due to advantages of stable picture, vivid images, eliminating radiation, saving space, and saving energy consumption, and have dominated the field of flat displays.

Since liquid crystal molecules' rotation in one direction for a long time will cause polarization of the liquid crystal molecules, in order to prevent or eliminate the polarization of liquid crystal molecules, the liquid crystal display can be controlled by means of polarity inversion. That is, electric fields in the opposite directions are applied to the liquid crystal molecules at different times. The polarization of the liquid crystal molecules refers to the phenomenon that the liquid crystal molecules lose their optical rotation and other characteristics when the liquid crystal molecules' rotation is fixed in one direction.

SUMMARY

The present disclosure provides a display control method and apparatus, a display apparatus, a storage medium, and a computer device.

In an aspect, a display control method is provided. The display control method comprises:

detecting a picture frame to be output; and controlling the plurality of data lines to output, in a first mode, data signals for displaying the picture frame to be output in response to detection that the picture frame to be output comprises a reference picture; wherein a signal polarity sequence in the first mode is different from a signal polarity sequence in a second mode, the second mode being an output mode of the plurality of data lines when the picture frame to be output does not comprise a reference picture, and the signal polarity sequence being a sequence of polarities of data signals provided by all of the plurality of data lines according to an arrangement order of the plurality of data lines in a display apparatus.

Optionally, in the first mode, the plurality of data lines is divided into a plurality of second data line groups arranged in sequence, each of the second data line groups comprises y data lines, the y data lines in each of the second data line groups provide data signals of the same polarity in a same display frame, data lines in adjacent second data line groups provide data signals of opposite polarities in a same display frame, and among the plurality of second data line groups, numbers of data lines in at least two of the second data line groups are different, where y is a non-zero natural number.

Optionally, in the first mode, according to an arrangement order of the plurality of second data line groups, numbers of data lines in the plurality of second data line groups meet the following rule:

a $(5\times q+1)^{th}$ second data line group comprises 1×m data lines;

a $(5\times q+2)^{th}$ second data line group comprises 2×m data lines;

a $(5\times q+3)^{th}$ second data line group comprises 2×m data lines;

a $(5\times q+4)^{th}$ second data line group comprises 2×m data lines; and a $(5\times q+5)^{th}$ second data line group comprises 1×m data lines, where q is a natural number, and m is a positive integer.

Optionally, in the first mode, according to an arrangement order of the plurality of second data line groups, a first second data line group comprises 1×m data lines, and other second data line groups each comprise 8×m data lines, the other second data line groups being data line groups, except the first second data line group, among the plurality of second data line groups, where m is a positive integer.

Optionally, in the second mode, the plurality of data lines is divided into a plurality of first data line groups arranged in sequence, each of the first data line groups comprises x data lines, the x data lines in each of the first data line groups provide data signals of the same polarity in a same display frame, data lines in adjacent data line groups provide data signals of opposite polarities in a same display frame, and numbers of data lines in the plurality of first data line groups are the same, where x is a non-zero natural number.

Optionally, in the second mode and the first mode, polarities of data signals provided by the same data line to display frames adjacent in timing sequence are opposite.

Optionally, the reference picture comprises a characteristic region, the characteristic region comprises a plurality of image pixels in an array, the plurality of image pixels is divided into a first image pixel group and a second image pixel group next to each other, grayscale values of image pixels in the first image pixel group are all greater than or equal to a first grayscale value, grayscale values of image pixels in the second image pixel group are all less than or equal to a second grayscale value, and the first grayscale value is greater than the second grayscale value; and the first image pixel group and the second image pixel group each comprise image pixels presented by sub-pixels provided with image signals by the same data line.

Optionally, when the display apparatus has a single-gate structure, the characteristic region comprises image pixels presented by sub-pixels in a first sub-pixel group and a second sub-pixel group in an $n^{th}$ row of sub-pixels and an $(n+1)^{th}$ row of sub-pixels, the first sub-pixel group comprises 2x+1 columns of sub-pixels, the second sub-pixel group comprises 2x+1 columns of sub-pixels, the image pixels presented by the sub-pixels in the first sub-pixel group form the first image pixel group, and the image pixels presented by the sub-pixels in the second sub-pixel group form the second image pixel group, where x is a natural number.

Optionally, when the display apparatus has a double-gate structure, the characteristic region comprises image pixels presented by sub-pixels in a first sub-pixel group and a second sub-pixel group in an $n^{th}$ row of sub-pixels and an $(n+1)^{th}$ row of sub-pixels, the first sub-pixel group comprises 4x+2 columns of sub-pixels, the second sub-pixel group comprises 4x+2 columns of sub-pixels, the image pixels presented by the sub-pixels in the first sub-pixel group form the first image pixel group, and the image pixels presented by the sub-pixels in the second sub-pixel group form the second image pixel group, where x is a natural number.

Optionally, the reference picture comprises a plurality of characteristic regions in an array.

Optionally, the second grayscale value is 0.

Optionally, the display control method further comprises: receiving a user instruction, and determining a picture indicated by the user instruction as the reference picture.

Optionally, the display control method further comprises: controlling the plurality of data lines to output data signals in the second mode in response to detection that the picture frame to be output does not comprise the reference picture.

By adopting the display control method according to the embodiment of the present disclosure, the output mode may be changed for a specific picture frame to be output, to reduce display failure caused by overall or local fluctuations of the common voltage value.

In another aspect, a display control apparatus is provided. The display control apparatus comprises: a processor, a memory, and a computer program stored in the memory and executable on the processor, wherein the processor executes the computer program to implement:

detecting a picture frame to be output; and controlling a plurality of data lines to output, in a first mode, data signals for displaying the picture frame to be output in response to detection that the picture frame to be output comprises a reference picture; wherein a signal polarity sequence in the first mode is different from a signal polarity sequence in a second mode, the second mode is an output mode of the plurality of data lines when the picture frame to be output does not comprise a reference picture, the signal polarity sequence is a sequence of polarities of data signals provided by all of the plurality of data lines according to an arrangement order of the plurality of data lines in a display apparatus.

Optionally, in the first mode, the plurality of data lines is divided into a plurality of second data line groups arranged in sequence, each of the second data line groups comprises y data lines, the y data lines in each of the second data line groups provide data signals of the same polarity in a same display frame, data lines in adjacent second data line groups provide data signals of opposite polarities in a same display frame, and among the plurality of second data line groups, numbers of data lines in at least two of the second data line groups are different, where y is a non-zero natural number.

Optionally, in the first mode, according to an arrangement order of the plurality of second data line groups, numbers of data lines in the plurality of second data line groups meet the following rule:

a $(5\times q+1)^{th}$ second data line group comprises 1×m data lines;

a $(5\times q+2)^{th}$ second data line group comprises 2×m data lines;

a $(5\times q+3)^{th}$ second data line group comprises 2×m data lines;

a $(5\times q+4)^{th}$ second data line group comprises 2×m data lines; and a $(5\times q+5)^{th}$ second data line group comprises 1×m data lines, where q is a natural number, and m is a positive integer.

Optionally, in the first mode, according to an arrangement order of the plurality of second data line groups, a first second data line group comprises 1×m data lines, and other second data line groups each comprise 8×m data lines, the other second data line groups being data line groups, except the first second data line group, among the plurality of second data line groups, where m is a positive integer.

Optionally, the control module is further configured to, in the second mode and the first mode, control polarities of data signals provided by the same data line to display frames adjacent in timing sequence to be opposite.

By adopting the display control apparatus according to the present disclosure, different modes can be selected to output a specific picture frame to be output, thereby reducing display failure caused by overall or local fluctuations of the common voltage value.

In yet another aspect, a display apparatus is provided. The display apparatus comprises: a display panel and a display control apparatus, wherein the display control apparatus is configured to control a data line to output a data signal to the display panel to perform image display, and the display control apparatus comprises: a processor, a memory, and a computer program stored in the memory and executable on the processor, and the processor executes the computer program to implement:

detecting a picture frame to be output; and controlling a plurality of data lines to output, in a first mode, data signals for displaying the picture frame to be output in response to detection that the picture frame to be output comprises a reference picture; wherein a signal polarity sequence in the first mode is different from a signal polarity sequence in a second mode, the second mode is an output mode of the plurality of data lines when the picture frame to be output does not comprise a reference picture, the signal polarity sequence is a sequence of polarities of data signals provided by all of the plurality of data lines according to an arrangement order of the plurality of data lines in the display apparatus.

Optionally, the display panel comprises: a plurality of data lines sequentially arranged in a first direction and a plurality of gate lines sequentially arranged in a second direction, the plurality of data lines and the plurality of gate lines intersect to form a plurality of sub-pixels in an array, each of the data lines alternately provides data signals to sub-pixels on two sides thereof, and sub-pixels provided with data signals by each of the data lines are arranged in a zigzag pattern.

By adopting the display control apparatus according to the present disclosure, different modes can be selected to output a specific picture frame to be output, thereby reducing display failure caused by overall or local fluctuations of the common voltage value.

In still yet another aspect, a computer-readable storage medium is provided. The computer-readable storage medium stores therein a computer program, wherein the computer-readable storage medium runs on a computer to enable the computer to implement:

detecting a picture frame to be output; and controlling a plurality of data lines to output, in a first mode, data signals for displaying the picture frame to be output in response to detection that the picture frame to be output comprises a reference picture; wherein a signal polarity sequence in the first mode is different from a signal polarity sequence in a second mode, the second mode is an output mode of the plurality of data lines when the picture frame to be output does not comprise a reference picture, the signal polarity sequence is a sequence of polarities of data signals provided by all of the plurality of data lines according to an arrangement order of the plurality of data lines in a display apparatus.

In still yet another aspect, a computer device is provided. The computer device comprises processor, a memory, and a computer program stored in the memory and executable on the processor, wherein the processor executes the computer program to implement:

detecting a picture frame to be output; and controlling a plurality of data lines to output, in a first mode, data signals for displaying the picture frame to be output in response to detection that the picture frame to be output comprises a reference picture; wherein a signal polarity sequence in the first mode is different from a signal polarity sequence in a second mode, the second mode is an output mode of the plurality of data lines when the picture frame to be output does not comprise a reference picture, the signal polarity sequence is a sequence of polarities of data signals provided by all of the plurality of data lines according to an arrangement order of the plurality of data lines in a display apparatus.

In still yet another aspect, a computer program product is provided. The computer program product, when running on a computer, enables the computer to implement:

detecting a picture frame to be output; and controlling a plurality of data lines to output, in a first mode, data signals for displaying the picture frame to be output in response to detection that the picture frame to be output comprises a reference picture; wherein a signal polarity sequence in the first mode is different from a signal polarity sequence in a second mode, the second mode is an output mode of the plurality of data lines when the picture frame to be output does not comprise a reference picture, the signal polarity sequence is a sequence of polarities of data signals provided by all of the plurality of data lines according to an arrangement order of the plurality of data lines in a display apparatus.

BRIEF DESCRIPTION OF THE DRAWINGS

In order to describe the technical solutions of the embodiments of the present disclosure more clearly, the accompanying drawings of the embodiments will be briefly introduced below. Apparently, the accompanying drawings in the following description merely relate to some embodiments of the present disclosure, rather than limit the present disclosure.

DETAILED DESCRIPTION

Figure 1:
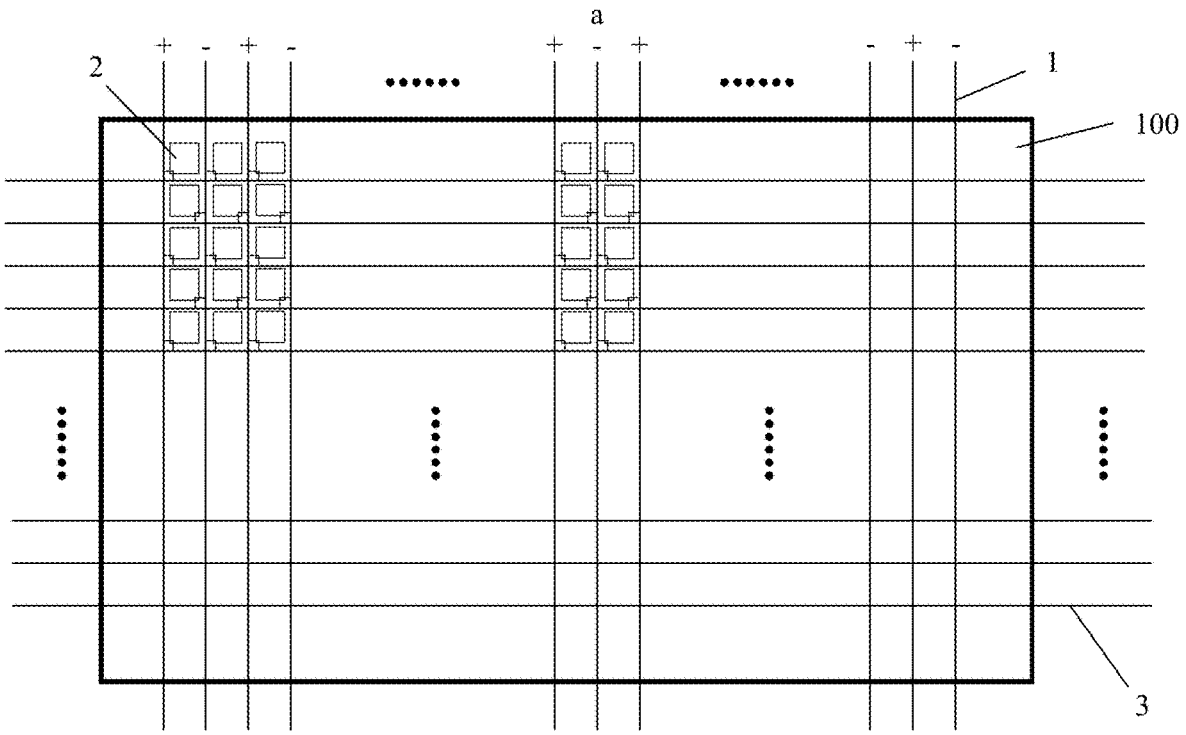
FIG. 1 is a schematic diagram of a display apparatus according to an embodiment of the present disclosure.

FIG. 1 is a schematic structural diagram of a display apparatus 100 according to an embodiment of the present disclosure. As shown in FIG. 1, the display apparatus 100 includes a plurality of data lines 1 sequentially arranged in a first direction and a plurality of gate lines 3 sequentially arranged in a second direction. The plurality of data lines 1 and the plurality of gate lines 3 intersect to form a plurality of sub-pixels 2 arranged in an array. In FIG. 1, the first direction is a column direction, and the second direction is a row direction. One data line 1 is provided between adjacent columns of sub-pixels, and one gate line 3 is provided between adjacent rows of sub-pixels 2. Each gate line 3 provides a scanning signal for a row of sub-pixels 2. The scanning signal is used to turn on a switching element in a pixel circuit in a sub-pixel corresponding to the gate line to charge a pixel electrode in a corresponding sub-pixel. Each data line alternately connects pixel electrodes in the column of sub-pixels on the left side and in the column of sub-pixels on the right side of the data line to provide a data signal. The sub-pixels where the pixel electrodes connected to each data line are located are arranged in a zigzag pattern. Liquid crystal molecules in a sub-pixel are driven by the pixel electrode in the sub-pixel and a common electrode to realize the inversion of the liquid crystal, thereby realizing the display of the overall display apparatus.

For example, as shown in FIG. 1, pixel electrodes connected to data line a are arranged in a zigzag pattern. That is, the data line a may be connected to the pixel electrode in the $a^{th}$ column of sub-pixel in the first row, the pixel electrode in the $(a+1)^{th}$ column of sub-pixel in the second row, the pixel electrode in the $a^{th}$ column of sub-pixel in the third row, and the pixel electrode in the $(a+1)^{th}$ column of sub-pixel in the fourth row, and so on.

The display apparatus provided in FIG. 1 may be driven in various ways. For example, in order to solve the problem of liquid crystal polarization and reduce crosstalk caused by capacitive coupling, a plurality of polarity inversion methods may be used for driving. For example, in the same display frame, the polarities of the data signals provided by each data line may be the same. Alternatively, the data signals provided by adjacent data lines may be different. However, when displaying certain specific pictures, if the display apparatus is still driven according to the two driving methods described above, the potential of the data signal provided by the data line will fluctuate, which affects the common voltage value Vcom of the common electrode and causes display failure of the display apparatus.

Figure 2:
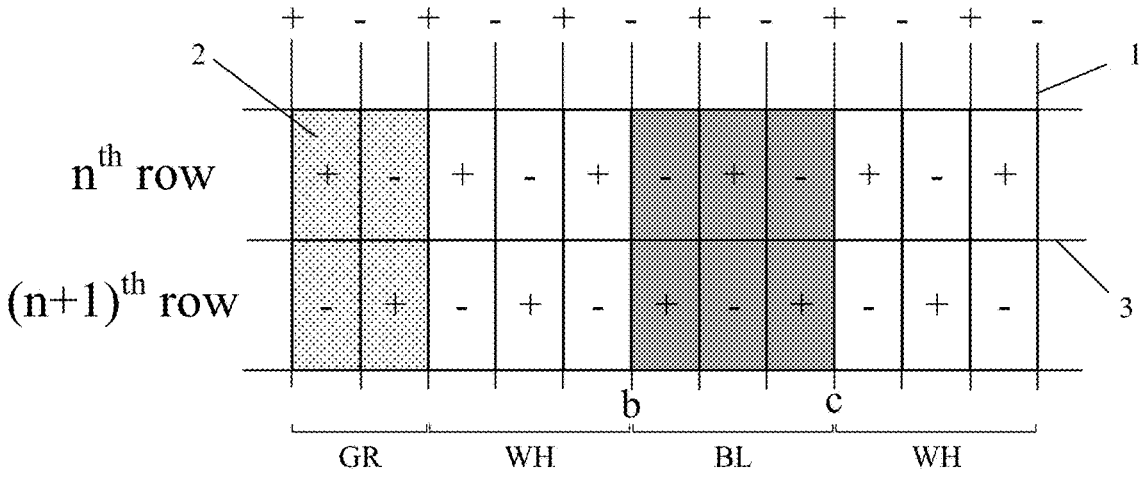
FIG. 2 is a schematic diagram of a specific picture and polarities of data signals output by corresponding data lines according to an embodiment of the present disclosure.

The specific picture may be a picture presented by a plurality of white-state image pixels (shown as unfilled square blocks in FIG. 2) and black-state image pixels (shown as gray filled square blocks in FIG. 2) arranged alternately as shown in FIG. 2. The white state (WH) may refer to that the grayscale of the image pixel is within a specific range. For example, the specific range may be that the grayscale is greater than L250. The black state (BL) may refer to that the grayscale of the image pixel is within a specific range. For example, the specific range may be that the grayscale is less than L10. The gray picture (GR) may refer to a picture presented by image pixels of which the grayscale is between the white state and the black state, and may refer to, for example, a picture presented by image pixels of which the grayscale is greater than L100 and less than L200. The gray picture (GR) may be made reference to the square blocks filled with dots in FIG. 2.

Figure 3:
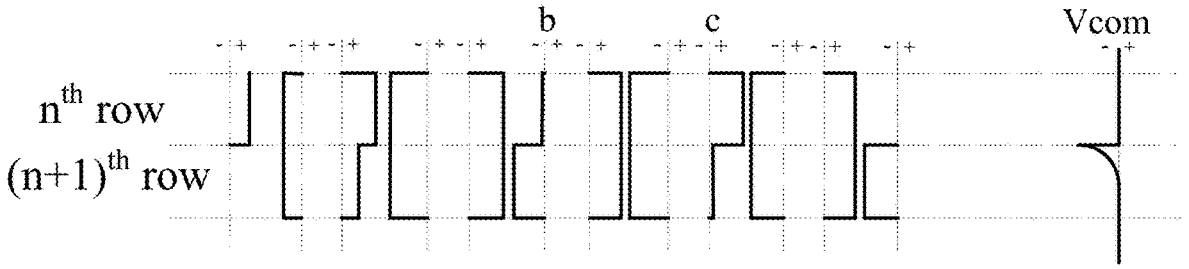
FIG. 3 is a schematic diagram of data signals output by data lines and a change trend of a potential of a common voltage value when the picture shown in FIG. 2 is displayed according to an embodiment of the present disclosure.

In the progressive scanning process, due to the potential fluctuation of the data line, capacitive coupling may occur between the data line and the common electrode, or between the data line and the common electrode line, thereby affecting the common voltage value on the common electrode. It is worth mentioning that the common voltage value mentioned here may be the overall or local common voltage value fluctuations of the common electrode. For example, FIG. 2 illustrates a polarity of a data signal output by each data line 1 during the display process. FIG. 3 illustrates data signals output by respective data lines and a change trend of a potential of the common voltage value Vcom on the common electrode during the display process. For the dotted line at the position of each data line in FIG. 3, the negative sign on the left side of the dotted line is used to indicate that the signal on the left side of the dotted line is a negative signal, and the positive sign on the right of the dotted line is used to indicate that the signal on the right side of the dotted line is a positive signal, and the farther the signal waveform is from the dotted line, the greater the absolute value of the signal. As shown in FIG. 3, the voltage value of the data signal, in the $n^{th}$ row, output by the data line b is much higher than the voltage value of the data signal, in the $(n+1)^{th}$ row, output by the data line b. In this case, under the influence of the capacitive coupling between the data line b and the common electrode, the common voltage value Vcom of the common electrode is pulled down by the voltage difference corresponding to the data line b, which causes the waveform of the common voltage value Vcom in the $(n+1)^{th}$ row to have a peak towards the negative direction in the negative direction, and may further cause crosstalk to other sub-pixels and affect the normal display of other display regions, such as the normal display of the GR region. Similarly, the voltage value of the data signal, in the $n^{th}$ row, output by the data line c is much higher than the voltage value of the data signal, in the $(n+1)^{th}$ row, output by the data line c. Under the influence of the capacitive coupling between the data line c and the common electrode, the common voltage value Vcom is further pulled down by the voltage difference corresponding to the data line c, resulting in crosstalk to other sub-pixels and affecting the normal display of other display regions, such as the normal display of the GR region. When the specific picture shown in FIG. 2 appears repeatedly, the impact will increase.

As known by the inventors, the situation may be improved by monitoring the common voltage fluctuations and adjusting the output way of the common voltage in real time according to the monitoring results, but the improvement solution still has problems. For example, when there is no obvious fluctuation in the monitored common voltage value and/or the overall common voltage value, the fluctuation of the common voltage cannot be monitored under this circumstance, resulting in the determination that the common voltage does not need to be adjusted based on the monitoring result. However, in this case, since the local common voltage value may have changed significantly, the picture displayed by the display apparatus may have presented obvious crosstalk. Therefore, this improvement solution cannot effectively adjust the common voltage. Alternatively, in the case where the display apparatus displays some pictures, although the fluctuation of the common voltage value is monitored, the display picture is not affected. If the common voltage value is adjusted according to the monitoring result under this circumstance, other new problems may be caused.

Figure 4:
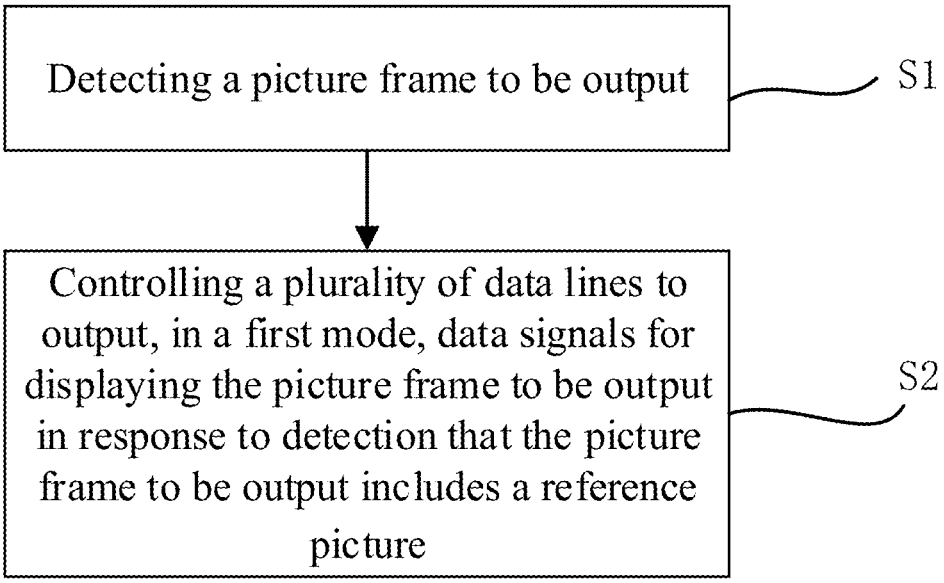
FIG. 4 is a schematic diagram of a display control method according to an embodiment of the present disclosure.

An embodiment of the present disclosure provides a display control method. As shown in FIG. 4, the method includes the following steps.

In step S1, a picture frame to be output is detected.

In step S2, in response to detection that the picture frame to be output includes a reference picture, a plurality of data lines is controlled to output, in a first mode, data signals for displaying the picture frame to be output.

A signal polarity sequence in the first mode is different from a signal polarity sequence in a second mode. The second mode is an output mode of the plurality of data lines when the picture frame to be output does not include the reference picture. The signal polarity sequence is a sequence of polarities of data signals provided by all of the plurality of data lines according to an arrangement order of the plurality of data lines. For example, it is supposed that the display apparatus includes a data line a, a data line b, and a data line c arranged sequentially, and the polarity of the data signal output by data line a is positive, the polarity of the data signal output by data line b is negative, and the polarity of the data signal output by data line c is positive, then the signal polarity sequence corresponding to data line a, data line b, and data line c are: positive, negative, and positive.

The display control method according to the embodiment of the present disclosure is applied to a display apparatus, which includes a plurality of data lines 1 sequentially arranged in a first direction. Each data line 1 is between sub-pixels 2 arranged in an array. Each data line 1 alternately connects a pixel electrode in a sub-pixel 2 on the left and right sides of the data line. The sub-pixels where the pixel electrodes connected to each data line are located are arranged in a zigzag pattern. The data line provides a data signal to the connected pixel electrodes for driving the connected pixel electrodes to be charged. For example, a display apparatus to which the display control method is applied may be the display apparatus shown in FIG. 1.

Optionally, a picture signal of a picture frame to be output may be detected, and the picture frame to be output may be determined according to the picture signal. For example, the display apparatus may include a control integrated circuit and a driving integrated circuit. The control integrated circuit may be used to detect the picture signal of the picture frame to be output and determine the picture frame to be output according to the picture signal. Correspondingly, when the control integrated circuit detects that the picture frame to be output includes the reference picture, the control integrated circuit sends a signal to the driving integrated circuit, so that the driving integrated circuit outputs a data signal in the first mode.

By adopting the display control method according to the embodiments of the present disclosure, the output mode may be changed for a specific picture frame to be output, to reduce the capacitance coupling between the data line and the common electrode or between the data line and the common electrode line to reduce the fluctuation of the overall or local common voltage value caused by capacitive coupling, thereby reducing display failure caused by the fluctuation.

The reference picture may be determined before the picture frame to be output is detected. For example, the reference picture may be determined before the display apparatus leaves the factory, or may be determined through smart learning, user settings, or according to big data push during the use of the display apparatus. For example, a user may send an instruction to set the reference picture according to his/her own usage habits and the actual display effect of the display apparatus. Correspondingly, as shown in FIG. 5, the method may further include step S3: receiving a user instruction, and determining a picture indicated by the user instruction as the reference picture.

In addition, there may be a plurality of implementations to detect the picture frame to be output. For example, in a first implementation, when the display device starts to perform the display process, the picture frame to be output may be detected, so that the data line outputs according to a corresponding detection result when each picture frame to be output is displayed. In a second implementation, when the display device starts to perform the display process, the plurality of data lines may be controlled to output according to the second mode, and then the picture frame to be output may be detected. In the subsequent display process, the data lines may be controlled to output according to the corresponding detection result. In a third implementation, when the display device does not start to perform the display process, the picture frame to be output may be detected first, and the output mode of the data line when the corresponding picture frame to be output is displayed is determined according to the detection result. Then, when the display device performs the display process, the data line is controlled to output according to the corresponding output mode.

The embodiment of the present disclosure takes the second implementation of detecting the picture frame to be output as an example to describe the implementation process of the display control method. For the implementation process of the display control method in other implementations, reference may be made to the implementation process in the second implementation accordingly.

Figure 5:
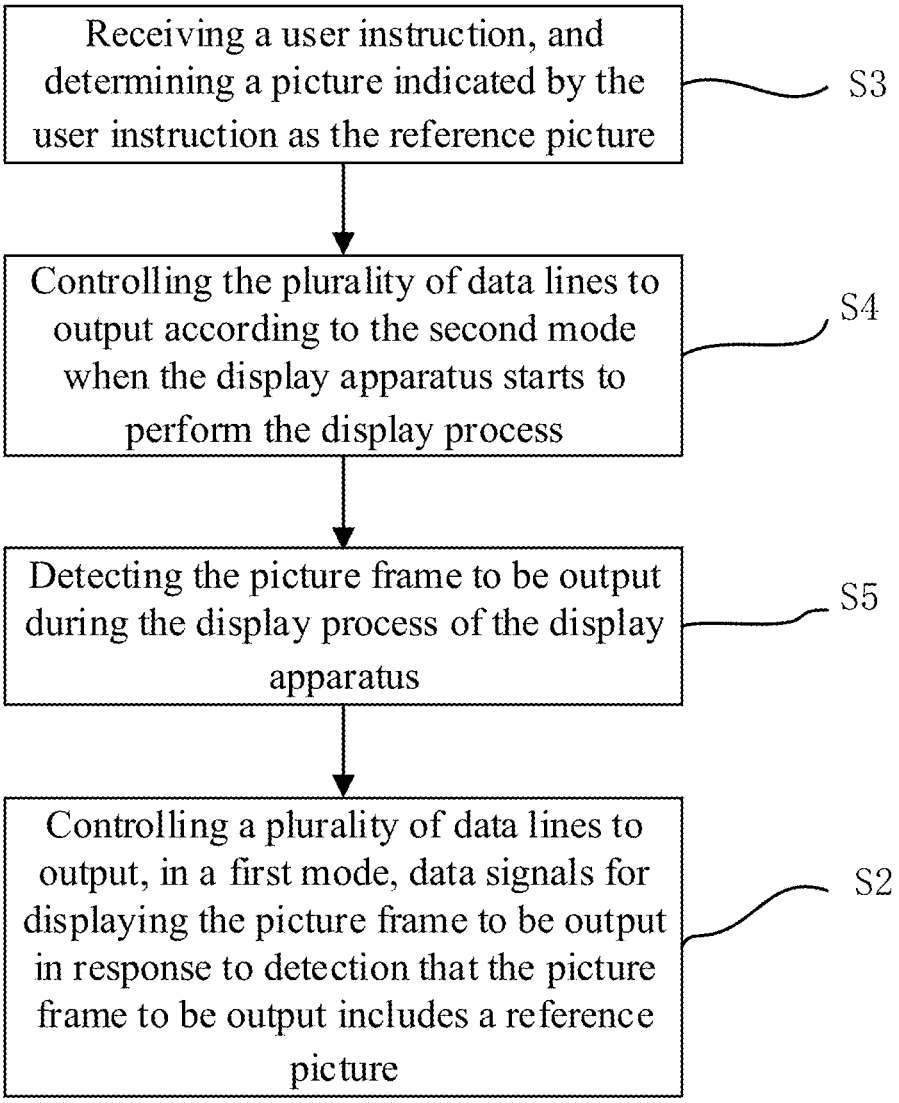
FIG. 5 is a schematic diagram of another display control method according to an embodiment of the present disclosure.

In this case, please continue to refer to FIG. 5. The display control method may further include step S4: when the display apparatus starts to perform the display process, controlling the plurality of data lines to output according to the second mode. Correspondingly, the implementation process of step S1 may include step S5: detecting the picture frame to be output during the display process of the display apparatus.

Figure 6:
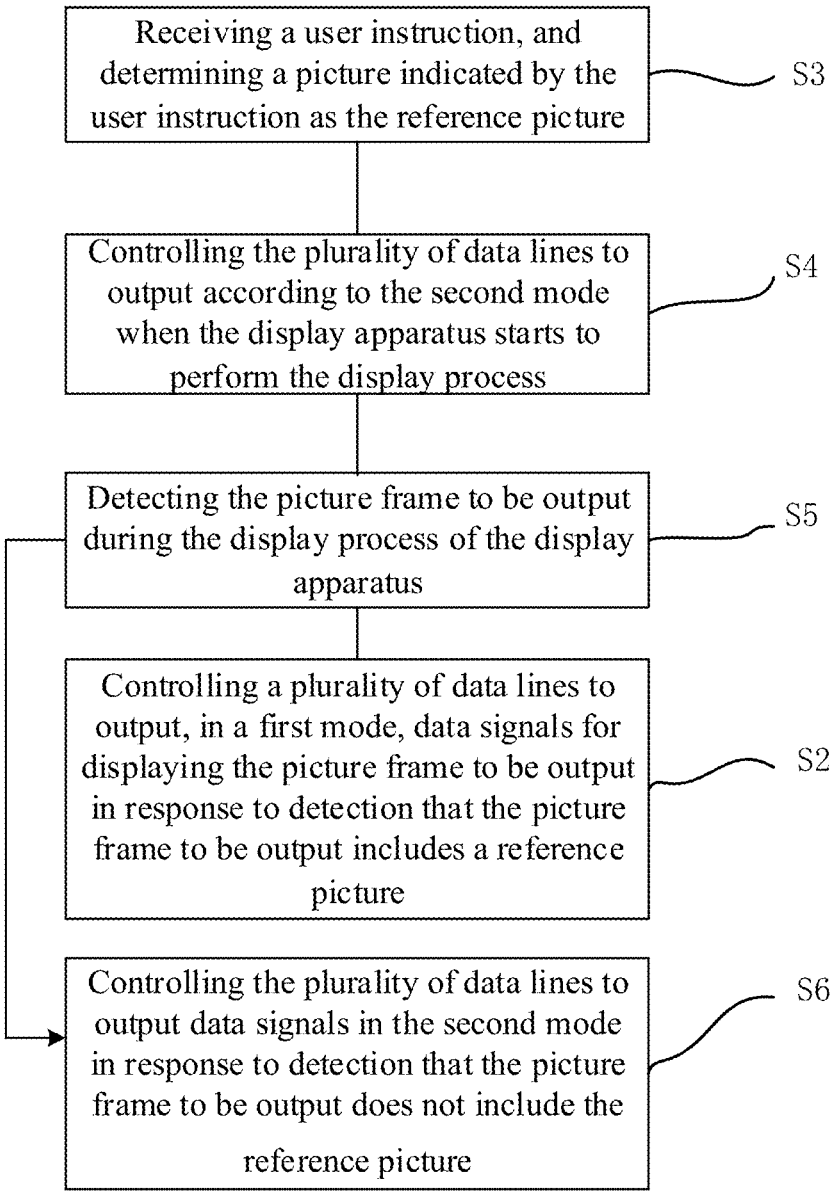
FIG. 6 is a schematic diagram of still another display control method according to an embodiment of the present disclosure.

In accordance with another display control method according to the embodiments of the present disclosure, as shown in FIG. 6, the display method may further include step S6: controlling the plurality of data lines to output data signals in the second mode in response to detection that the picture frame to be output does not include the reference picture.

It should be noted that the display control method according to the present disclosure is not limited to the output mode in the above-mentioned second mode and first mode, and the applicable scope of the embodiments of the present disclosure may be extended according to actual needs. For example, the output mode may be adjusted according to different rules for different specific pictures. It is conceivable for those skilled in the art, after understanding the idea of the present disclosure, to add alternate output modes within the scope disclosed in the embodiments of the present disclosure without creative efforts.

It is worth mentioning that it may be seen that the serial numbers of the above embodiments are only for description, and are not intended to indicate or imply the order of the steps in the methods. Taking step S5 as an example, during the display process, the picture signal of the picture frame to be output may be detected in real time, or an interval time may be set to perform the detection during the display process. According to the embodiments of the present disclosure, after step S2 or S6, step S5 still needs to be performed to detect the picture signal of the frame to be output. Variations of the steps in the methods made by those skilled in the art, without creative effort, according to the actual needs also fall into the scope protected by this disclosure.

In accordance with another display control method according to an embodiment of the present disclosure, the output modes in the second mode and the first mode are different. For example, the polarity settings when the data line provides a data signal are different in the second mode and the first mode.

Figure 7:
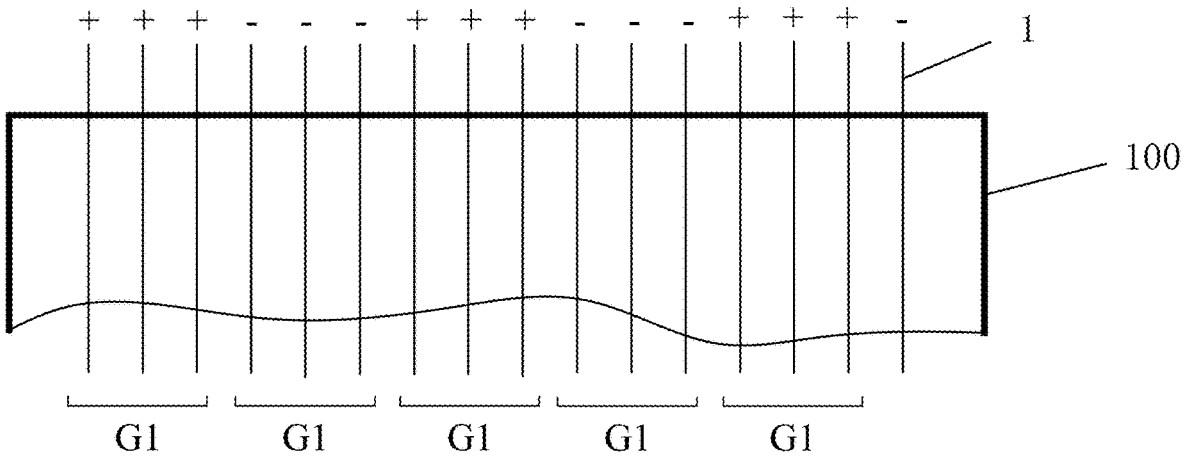
FIG. 7 is a schematic diagram of a signal polarity sequence corresponding to a plurality of data lines in a second mode according to an embodiment of the present disclosure.

For example, as shown in FIG. 7, in the second mode, the plurality of data lines 1 of the display apparatus is divided into a plurality of first data line groups G1 arranged in sequence. Each first data line group G1 includes x data lines 1. The x data lines 1 in each first data line group G1 provide signals of the same polarity in the same display frame. The data lines 1 in adjacent first data line groups G1 provide signals of opposite polarities in the same display frame. The number of data lines 1 included in the plurality of first data line groups G1 is the same. X is a non-zero natural number. FIG. 7 is a schematic diagram illustrating that each first data line group G1 include three data lines 1.

Figure 8:
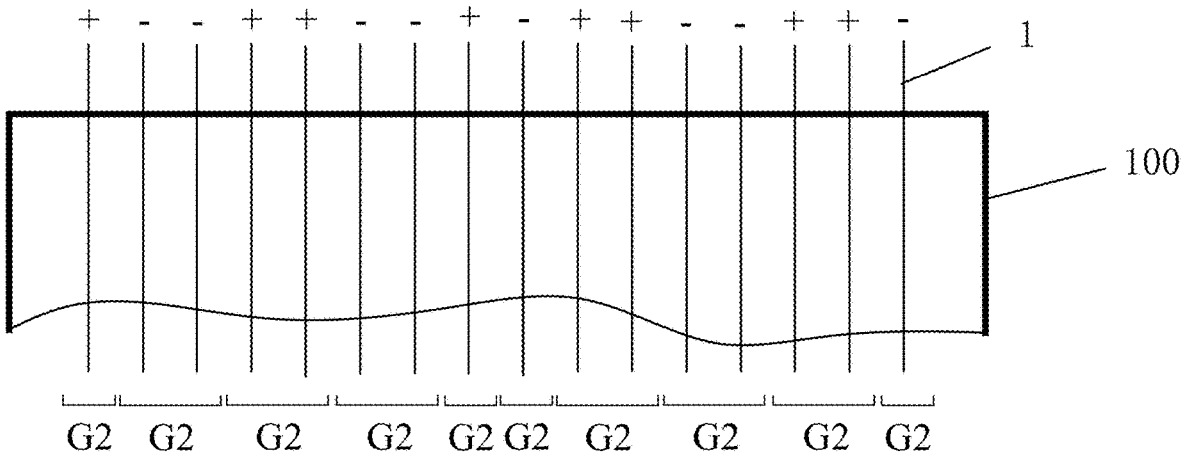
FIG. 8 is a schematic diagram of a signal polarity sequence corresponding to a plurality of data lines in a first mode according to an embodiment of the present disclosure.
Figure 9:
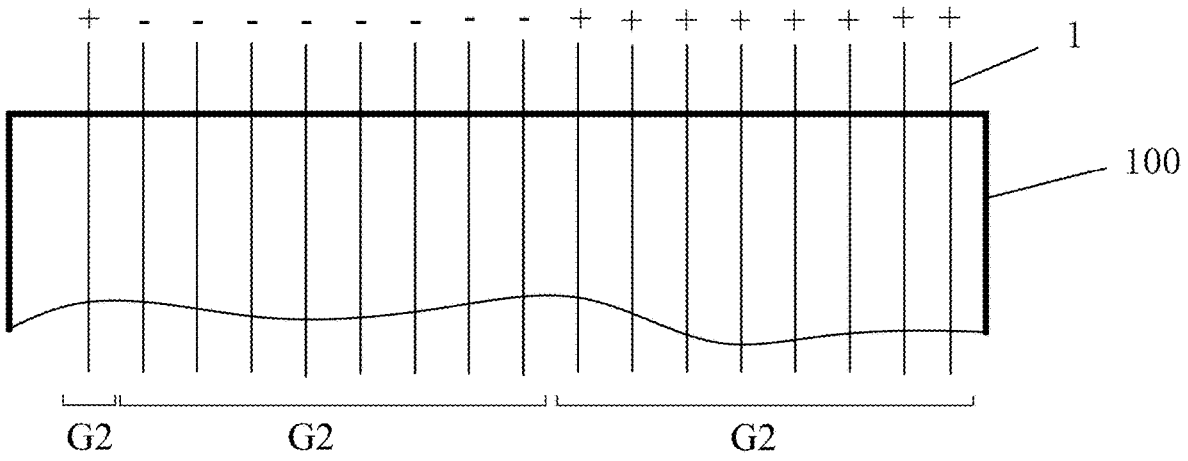
FIG. 9 is a schematic diagram of a signal polarity sequence corresponding to a plurality of data lines in another first mode according to an embodiment of the present disclosure.

As shown in FIGS. 8 and 9, in the first mode, the plurality of data lines 1 of the display apparatus is divided into a plurality of second data line groups G2 arranged in sequence. Each second data line group G2 includes y data lines 1. The y data lines 1 in each second data line group provide signals of the same polarity in the same display frame. The data lines 1 in adjacent data line groups G2 provide signals of opposite polarities in the same display frame. Among the plurality of second data line groups G2, at least two second data line groups include different numbers of data lines 1. Y is a non-zero natural number.

As shown in FIG. 8, in an implementation of the first mode, according to an arrangement order of the plurality of second data line groups G2, the numbers of data lines 1 included in the plurality of second data line groups G2 satisfy the following rule: the $(5\times q+1)^{th}$ second data line group G2 includes 1×m data lines 1, the $(5\times q+2)^{th}$ second data line group G2 includes 2×m data lines 1, the $(5\times q+3)^{th}$ second data line group G2 includes 2×m data lines 1, the $(5\times q+4)^{th}$ second data line group G2 includes 2×m data lines 1, and the $(5\times q+5)^{th}$ second data line group G2 includes 1×m data lines 1, where q is a natural number, and m is a positive integer. FIG. 8 is a schematic diagram when q=1 and m=1. In this case, the signal polarity sequence corresponding to the plurality of data lines is looped with 16 data lines as a unit. The signal polarity sequence corresponding to the 16 data lines is: positive, negative, negative, positive, positive, negative, negative, positive, negative, positive, positive, negative, negative, positive, positive and negative.

As shown in FIG. 9, in another implementation of the first mode, according to the arrangement order of the plurality of second data line groups G2, the first second data line group G2 includes 1×m data lines 1, and other second data line groups G2 each include 8×m data lines 1. The other second data line groups G2 are data line groups in the second data line groups G2 except the first second data line group G2, where m is a positive integer. FIG. 9 is a schematic diagram when m=1. In this case, the signal polarity sequence corresponding to the plurality of data lines is looped with 16 data lines as a unit. The signal polarity sequence corresponding to the 16 data lines is: positive, negative, negative, negative, negative, negative, negative, negative, negative, positive, positive, positive, positive, positive, positive, and positive.

Furthermore, in order to further reduce the capacitive coupling between the data line and the common electrode or between the data line and the common electrode line, in the second mode and the first mode, the polarities of the data signals provided by the same data line to display frames adjacent in timing sequence may be opposite.

Figure 10:
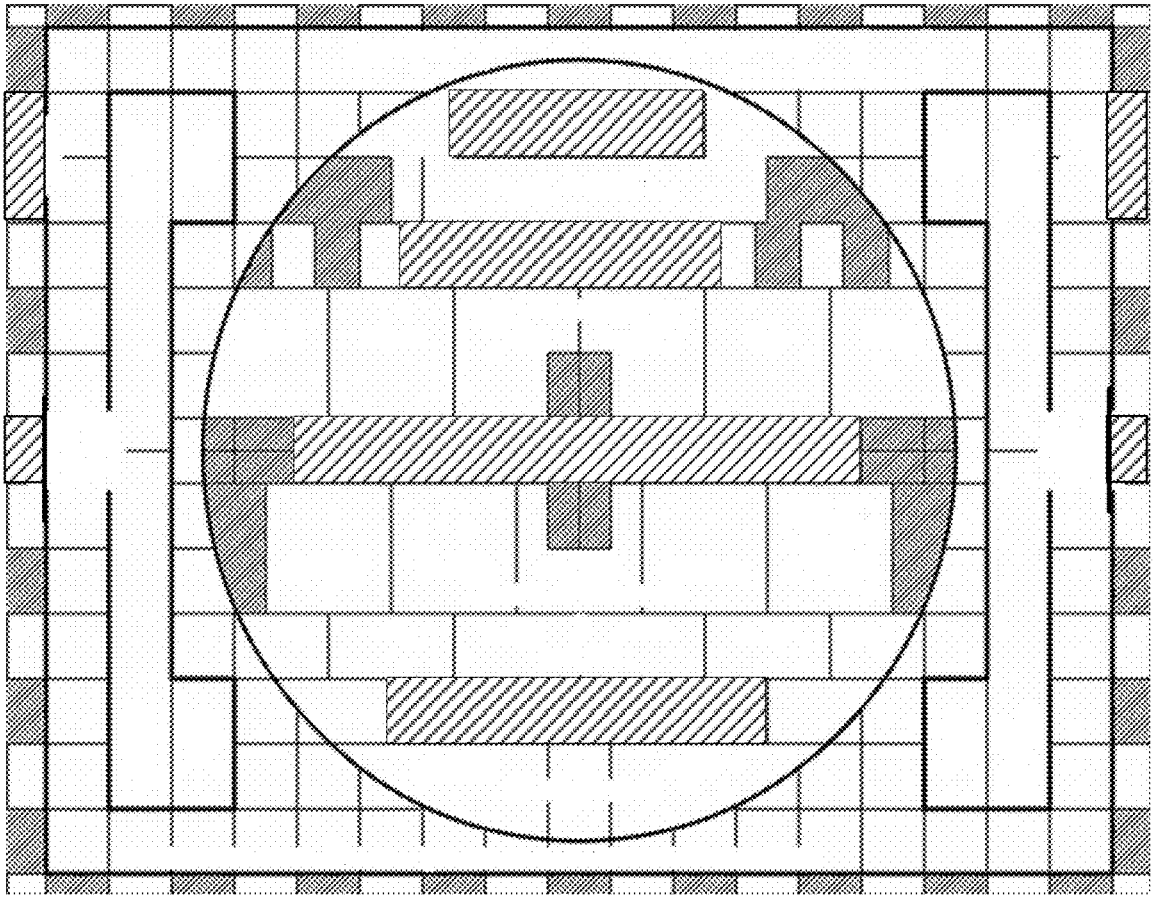
FIG. 10 is a schematic diagram of a reference picture according to an embodiment of the present disclosure.
Figure 11:
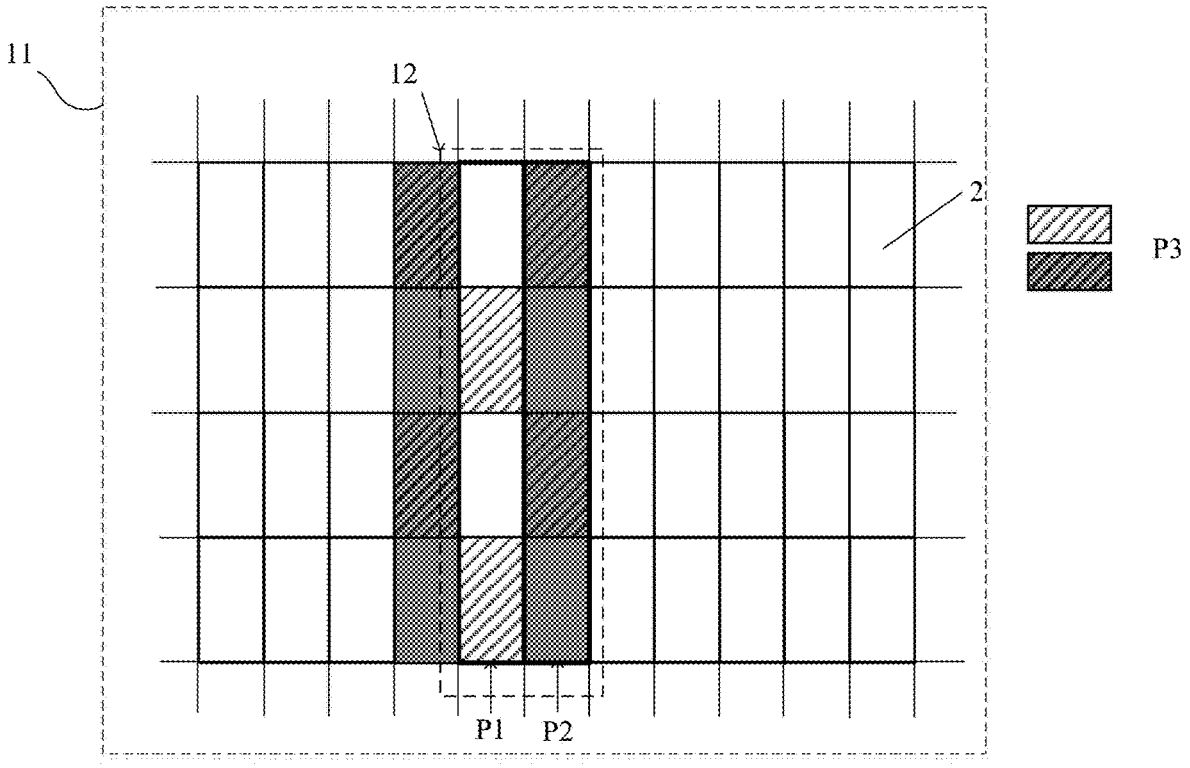
FIG. 11 is a schematic diagram of another reference picture according to an embodiment of the present disclosure.

In accordance with the display control method according to the embodiments of the present disclosure, the reference picture 11 may be set in various forms. For example, the reference picture 11 may include a characteristic region, which is a typical region of the reference picture 11 and a direct cause of poor display. For example, FIG. 10 and FIG. 11 are schematic diagrams of the reference picture 11 according to the embodiments of the present disclosure. It can be seen from FIG. 10 and FIG. 11 that the reference picture 11 includes a variety of complex characteristic regions.

As shown in FIG. 11, one characteristic region 12 may include a plurality of image pixels arranged in an array. These image pixels 2 include a first image pixel group P1 and a second image pixel group P2 arranged next to each other. Grayscale values of image pixels in the first image pixel group P1 are all greater than or equal to a first grayscale value Lhigh. Grayscale values of image pixels in the second image pixel group P2 are all less than or equal to a second grayscale value Llow. The first grayscale value Lhigh is greater than the second grayscale value Llow.

A plurality of different image pixels in the first image pixel group P1 and the second image pixel group P2 may form a characteristic image pixel group P3. The image pixels in each characteristic image pixel group P3 are image pixels presented by sub-pixels provided with data signals by the same data line. That is, the first image pixel group and the second image pixel group each include image pixels presented by sub-pixels provided with image signals by the same data line.

It is worth noting that the grayscale values of the image pixels in FIG. 11 are represented by the grayscales of the image pixels, and the oblique lines in the characteristic image pixel groups P3 are only used to distinguish the image pixels included in the characteristic image pixel groups P3 from other image pixels, and are not used to represent the grayscales of the image pixels. In addition, the first grayscale value Lhigh and the second grayscale value Llow may be selected according to needs and the actual situation of the display apparatus. For example, in an embodiment of the present disclosure, the first grayscale value Lhigh may be selected as L250, and the second grayscale value Llow may be selected as L10. It is worth mentioning that the embodiments of the present disclosure are not limited thereto. The first grayscale value Lhigh and the second grayscale value Llow may be various. For example, the first grayscale value Lhigh is L200, and the second grayscale value Llow is L0.

Optionally, the reference picture 11 may include one characteristic region, or may include a plurality of characteristic regions. In addition, the plurality of characteristic regions may be arranged in an array in the entire reference picture 11, or may be dispersedly arranged in the entire reference picture 11.

Figure 12:
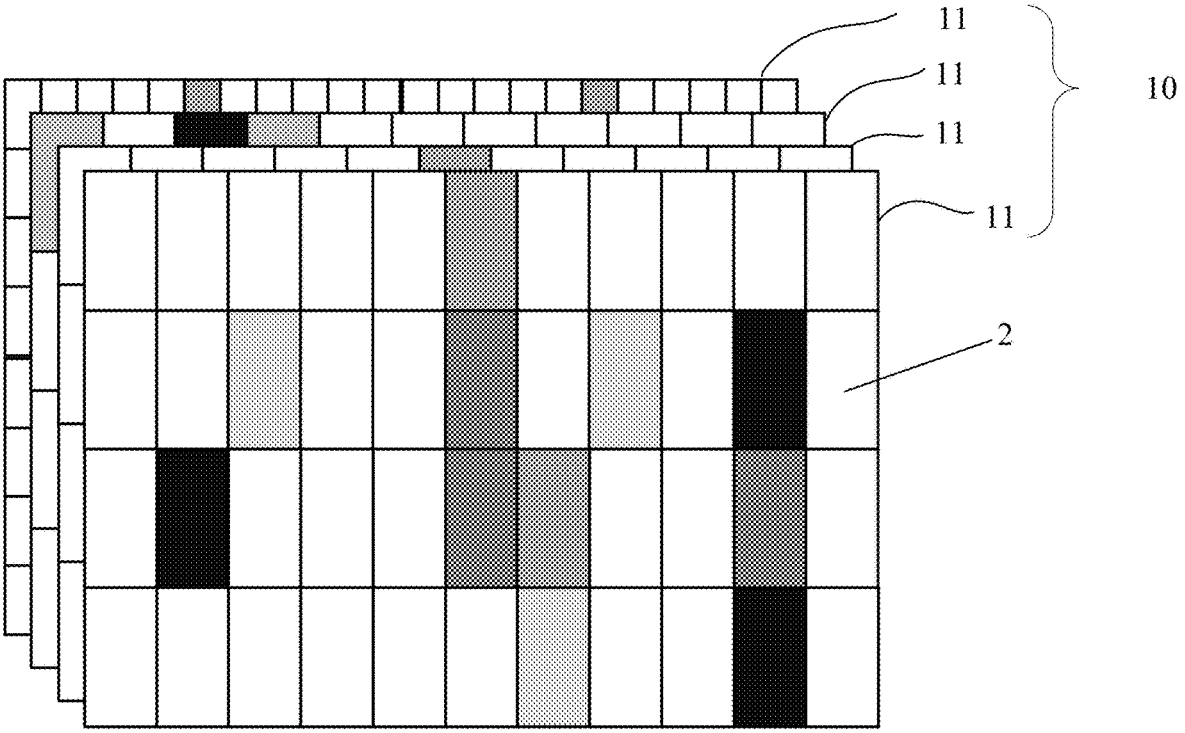
FIG. 12 is a schematic diagram of a reference picture group according to an embodiment of the present disclosure.

Furthermore, in step S3, a reference picture group may also be determined according to a user instruction. As shown in FIG. 12, a reference picture group 10 may include one reference picture 11 or a plurality of different reference pictures 11. Correspondingly, in step S2, in response to detection that the picture frame to be output does not include the reference picture, that the picture to be output includes any reference picture 11 in the reference picture group 10, the plurality of data lines may be controlled to output data signals in the first mode.

Optionally, the display control method according to the embodiments of the present disclosure may be applied to the display apparatus 100 shown in FIG. 1. The display apparatus 100 may have a single gate structure. In one implementation, a plurality of gate lines 3 is arranged along the row direction. Each gate line 3 is configured to control a row of sub-pixels 2. There is only one gate line 3 between adjacent rows of sub-pixels 2. In addition, the data line 1 may be set in a plurality of ways. For example, as shown in FIG. 1, there is one data line 1 between adjacent columns of sub-pixels 2.

In this case, the characteristic region may include image pixels presented by at least two rows of sub-pixels 2 which include the $n^{th}$ and $(n+1)^{th}$ rows of sub-pixels arranged in an array. These sub-pixels 2 are all sub-pixels in the first sub-pixel group and the second sub-pixel group. The first sub-pixel group may include the first 2x+1 columns of sub-pixels 2 in the $n^{th}$ and $(n+1)^{th}$ rows. The second sub-pixel group includes 2x+1 columns of sub-pixels 2, adjacent to the first sub-pixel group, in the $n^{th}$ row and $(n+1)^{th}$ row. Correspondingly, the image pixels presented by the sub-pixels 2 in the first sub-pixel group form a first image pixel group P1, and the image pixels presented by the sub-pixels 2 in the second sub-pixel group form a second image pixel group P2.

Figure 13:
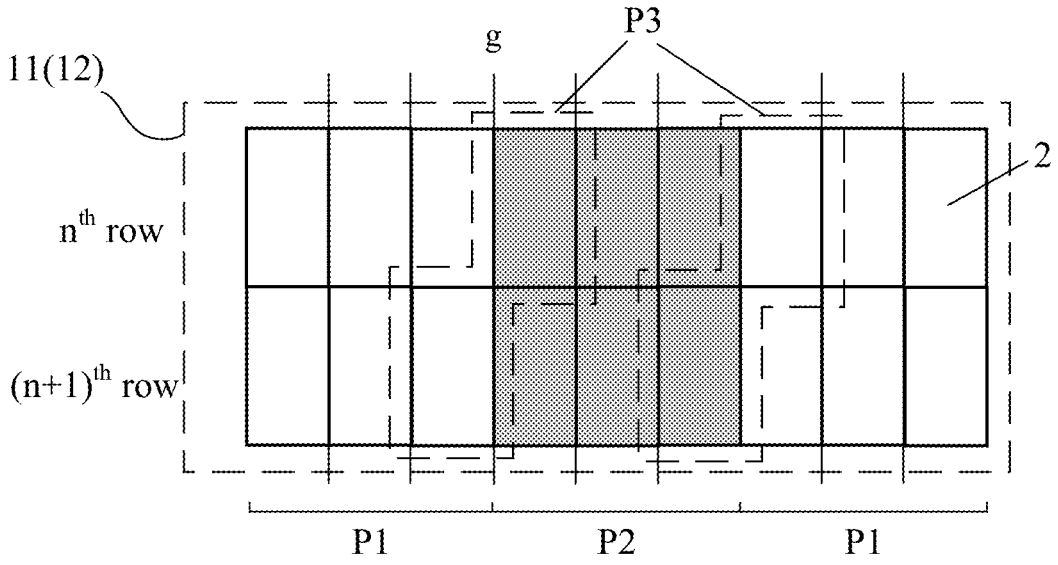
FIG. 13 is a schematic diagram of a reference picture or a characteristic region according to an embodiment of the present disclosure.

For example, as shown in FIG. 13, FIG. 13 is a schematic diagram of a typical reference picture 11. The preset picture 11 includes a characteristic region 12. When x is 1, in the second mode, adjacent data lines 1 provide opposite data signals. In the first mode, the signal polarity sequence corresponding to the plurality of data lines is looped with 16 data lines as a unit. The signal polarity sequence corresponding to the 16 data lines is: positive, negative, negative, positive, positive, negative, negative, positive, negative, positive, positive, negative, negative, positive, positive, and negative, or: positive, negative, negative, negative, negative, negative, negative, negative, negative, positive, positive, positive, positive, positive, positive, positive.

In this case, the characteristic region 12 may include: a first image pixel group P1 presented by sub-pixels 2 in a first sub-pixel group, and a second image pixel group P2 presented by sub-pixels 2 in a second sub-pixel group. The two rows and three columns of sub-pixels 2 form the second sub-pixel group. The first sub-pixel group is adjacent to the second sub-pixel group. The first pixel group and the second pixel group each include two rows and three columns of sub-pixels. In addition, the first sub-pixel group and the second sub-pixel group each include sub-pixels provided with data signals by the same data line (such as data line g). The sub-pixels, provided with data signals by the same data line, in the first sub-pixel group and the second sub-pixel group form a characteristic sub-pixel group. Correspondingly, as shown in FIG. 13, the image presented by each characteristic sub-pixel group is a characteristic image pixel group P3.

Figure 14:
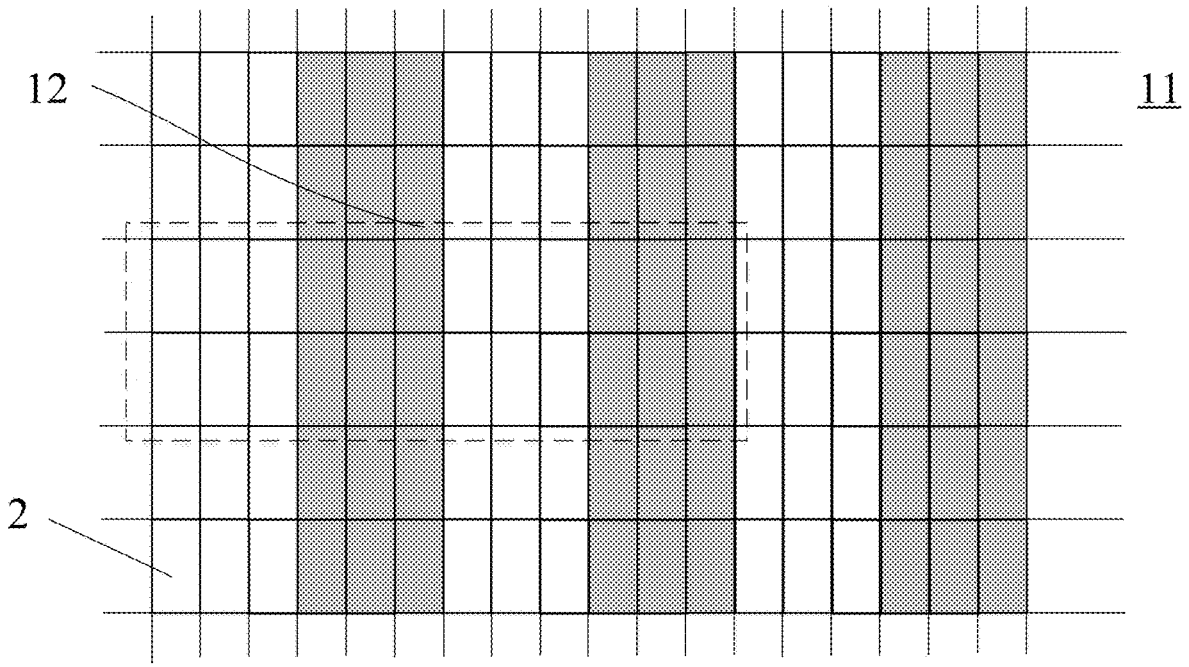
FIG. 14 is a schematic diagram of still another reference picture according to an embodiment of the present disclosure.

Further, as shown in FIG. 14, the reference picture may also include a plurality of identical characteristic regions 12. The plurality of characteristic regions 12 may be arranged in an array.

Figure 15:
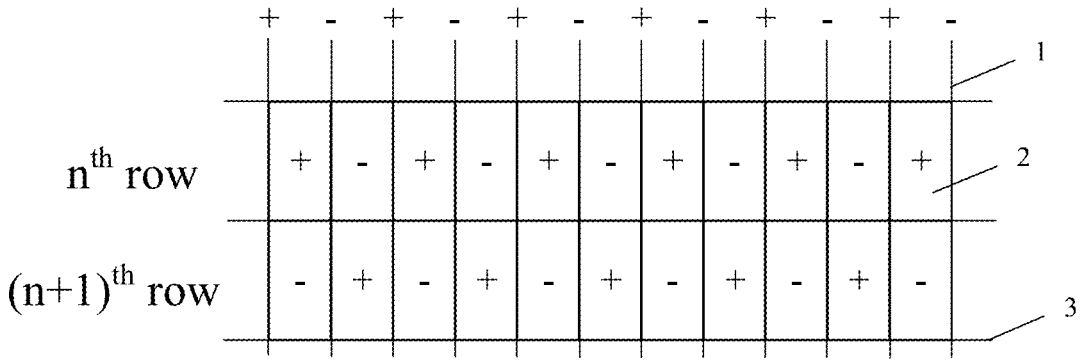
FIG. 15 is a schematic diagram of a signal polarity sequence corresponding to a plurality of data lines in another second mode according to an embodiment of the present disclosure.

When each characteristic region 12 is the characteristic region shown in FIG. 13 and x=1, in the second mode, the signal polarity sequence corresponding to the plurality of data lines is shown in FIG. 15, that is, adjacent data lines provide data signals of opposite polarities. In the first mode, please refer to FIG. 8 and FIG. 9 for the signal polarity sequence corresponding to the plurality of data lines. That is, the signal polarity sequence corresponding to the plurality of data lines is looped in units of 16 data lines. The signal polarity sequence corresponding to the 16 data lines is: positive, negative, negative, positive, positive, negative, negative, positive, negative, positive, positive, negative, negative, positive, positive, and negative (as shown in FIG. 8), or: positive, negative, negative, negative, negative, negative, negative, negative, negative, positive, positive, positive, positive, positive, positive, and positive (as shown in FIG. 9).

Figure 16:
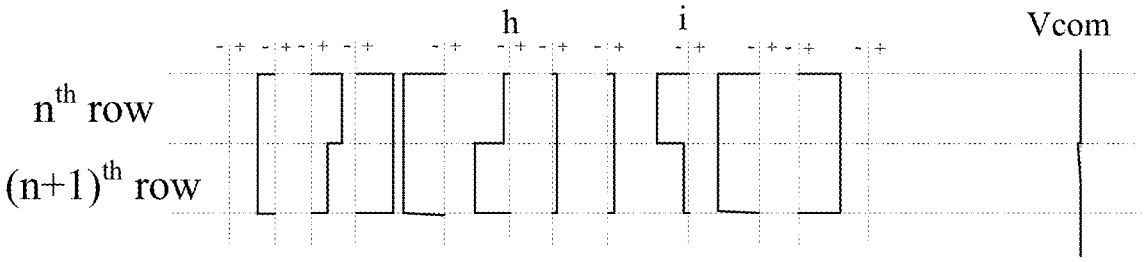
FIG. 16 is another schematic diagram of data signals output by a plurality of data lines and a change trend of a potential of a common voltage value in another first mode according to another embodiment of the disclosure.

As may be seen from the above, in accordance with the display control method according to the present disclosure, in the second mode, the display apparatus can output normally, and at the same time, functions such as inversion can be realized. In response to detection that the picture frame to be output does not include the reference picture, that the picture frame to be output includes the reference picture, the display apparatus outputs in the first mode. At this time, the data signals in the plurality of data lines 1 and the change trend of the potential of the common voltage value Vcom are shown in FIG. 16. It can be seen from FIG. 16 that change trends of potentials of the data signals output by data line h and data line i are opposite, and the effects of the two on the common voltage value Vcom cancel each other out, which can reduce the capacitance coupling between the data line and the electrode line and effectively reduce local or overall fluctuations in the common voltage value Vcom caused by capacitive coupling, thereby reducing or solving display failures caused by local or overall fluctuations in the common voltage value Vcom.

Figure 17:
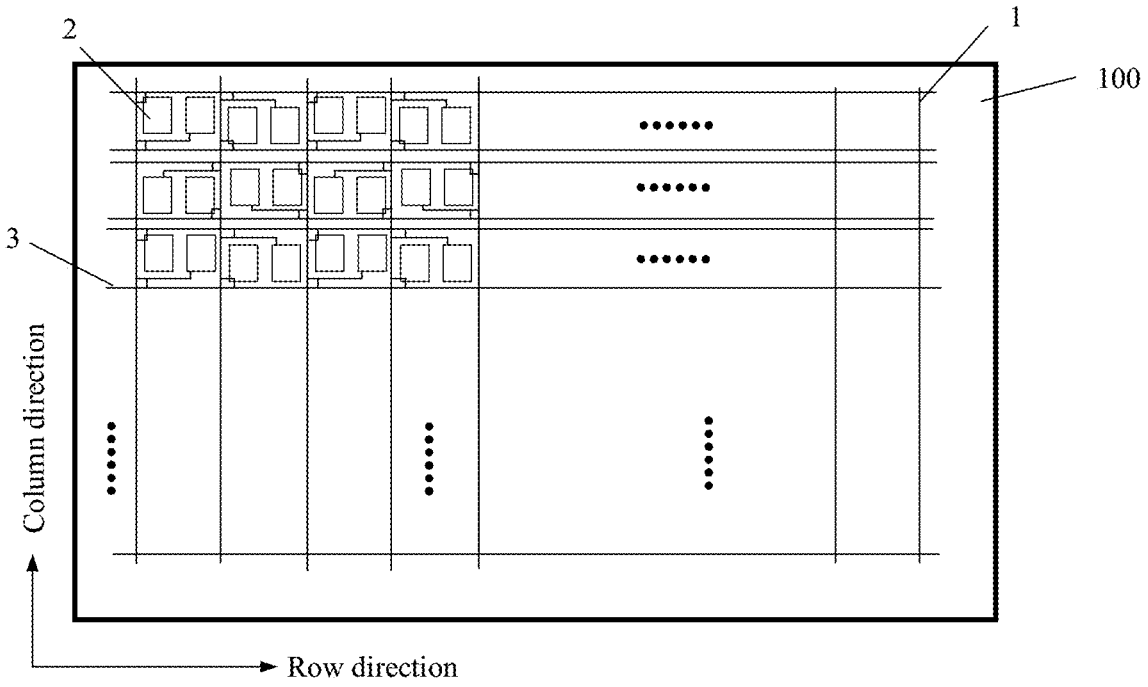
FIG. 17 is a schematic diagram of another display apparatus according to an embodiment of the present disclosure.

Optionally, the display control method according to the embodiments of the present disclosure may also be applied to the display apparatus 100 shown in FIG. 17. The display apparatus 100 has a double-gate structure. In one implementation, a plurality of gate lines 3 is arranged along the row direction. Gate lines 3 on the upper and lower sides of the same row of sub-pixels 2 are configured to jointly control a row of sub-pixels 2. There are two gate lines 3 between two adjacent rows of sub-pixels 2. In addition, the data line 1 may be set in a plurality of ways. For example, as shown in FIG. 17, one data line 1 is provided between two adjacent columns of sub-pixels 2.

When the display apparatus has a double-gate structure, the implementation of the corresponding characteristic region and the implementation of the signal polarity sequence corresponding to the plurality of data lines may be made reference to the implementation when the display apparatus has a single-gate structure. The difference is that the first sub-pixel group may include the first 4x+2 columns of sub-pixels 2 of the $n^{th}$ and $(n+1)^{th}$ rows of sub-pixels. The second sub-pixel group includes 4x+2 columns of sub-pixels 2, adjacent to the first sub-pixel group, of the $n^{th}$ and $(n+1)^{th}$ rows of sub-pixels. That is, in the double-gate structure, the number of columns of the sub-pixels included in the first sub-pixel group is twice the number of columns of the sub-pixels included in the first sub-pixel group in the single-gate structure, and the number of columns of the sub-pixels included in the second sub-pixel group is twice the number of columns of the sub-pixels included in the second sub-pixel group in the single-gate structure.

Figure 18:
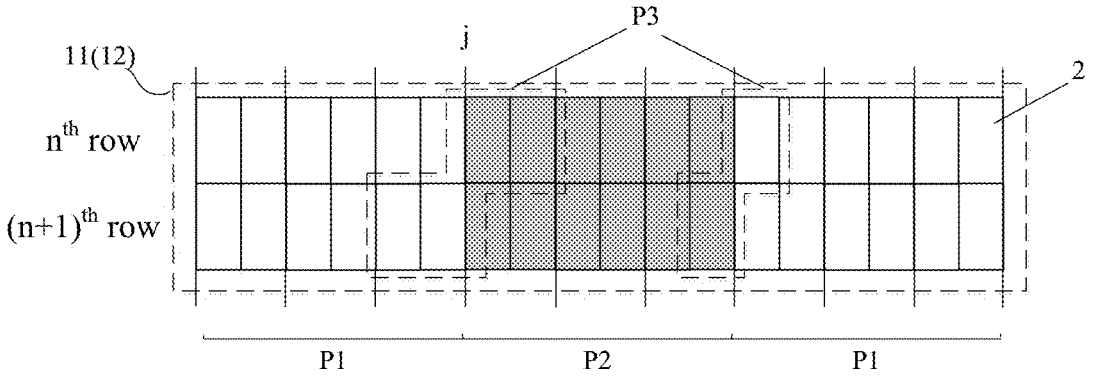
FIG. 18 is a schematic diagram of another reference picture or characteristic region according to an embodiment of the present disclosure.

For example, as shown in FIG. 18, the characteristic region 12 may include a first image pixel group P1 presented by a first sub-pixel group including two rows and six columns of sub-pixels 2 and a second image pixel group P2 presented by a second sub-pixel group including two rows and six columns of sub-pixels 2. The first sub-pixel group is adjacent to the second sub-pixel group. The first sub-pixel group and the second sub-pixel group each include sub-pixels 2 provided with data signals by the same data line (such as data line j). The sub-pixels 2, provided with data signals by the same data line, in the first sub-pixel group and the second sub-pixel group form a characteristic sub-pixel group. As shown in FIG. 18, the image presented by each characteristic sub-pixel group is a characteristic image pixel group P3.

Figure 19:
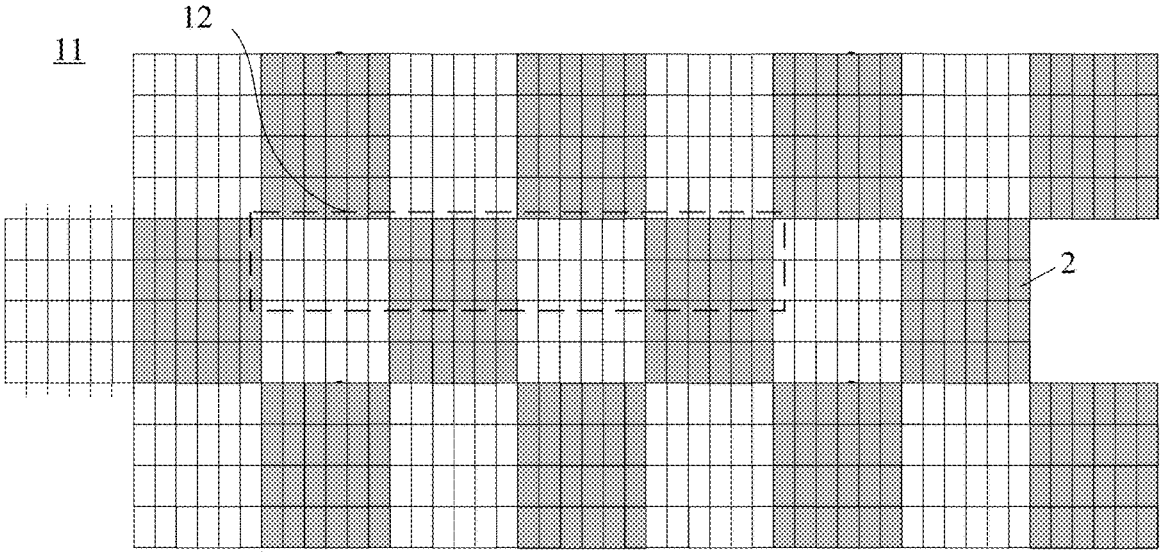
FIG. 19 is a schematic diagram of still another reference picture according to an embodiment of the present disclosure.

Also, as shown in FIG. 19, the reference picture may include a plurality of identical characteristic regions 12. The plurality of characteristic regions 12 is arranged in an array.

Corresponding to each characteristic region 12, for the signal polarity sequence corresponding to the data lines in the first mode, please refer to the signal polarity sequence in the single gate structure. When x=1, in the second mode, the signal polarity sequence corresponding to the plurality of data lines may be made reference to FIG. 15. In the first mode, please refer to FIG. 8 or FIG. 9 for the signal polarity sequence corresponding to the plurality of data lines.

Figure 20:
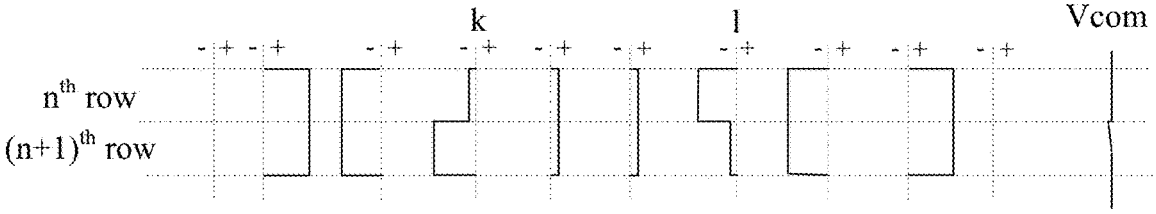
FIG. 20 is a schematic diagram of data signals output by a plurality of data lines and a change trend of a potential of a common voltage value still another first mode according to another embodiment of the present disclosure.

As may be seen from the above, in accordance with the display control method according to the present disclosure, in the second mode, the display apparatus can output normally, and at the same time, functions such as inversion can be realized. In response to detection that the picture frame to be output does not include the reference picture, that the picture frame to be output includes the reference picture, the display apparatus outputs in the first mode. At this time, the data signals in the plurality of data lines 1 and the change trend of the potential of the common voltage value Vcom are shown in FIG. 20. It can be seen from FIG. 20 that the change trends of potentials of the data signals output by data line k and data line 1 are opposite, and the influence of the two on the common voltage value Vcom cancel each other out, which can reduce the capacitive coupling between the data line and the common electrode line and effectively reduce local or overall fluctuations in the common voltage value Vcom caused by capacitive coupling, thereby reducing or solving display failures caused by local or overall fluctuations in the common voltage value Vcom.

It is worth mentioning that the foregoing descriptions are implementations of the display control method when the display apparatus according to the embodiments of the present disclosure has a single-gate structure and a double-gate structure. When those skilled in the art adjust the implementations of the display apparatus according to the different structures of the display apparatus without going beyond the principle of the core implementations of the present disclosure, the adjusted implementations should also be covered within the protection scope of the embodiments of the present disclosure.

Figure 21:
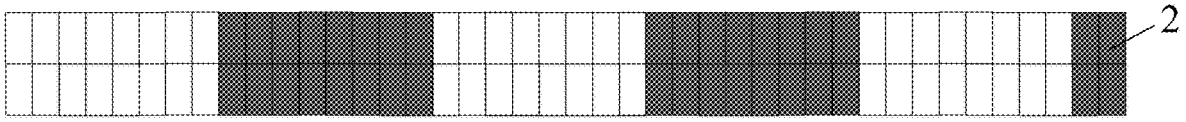
FIG. 21 is a schematic diagram of a typical picture in a reference picture according to an embodiment of the present disclosure.
Figure 22:
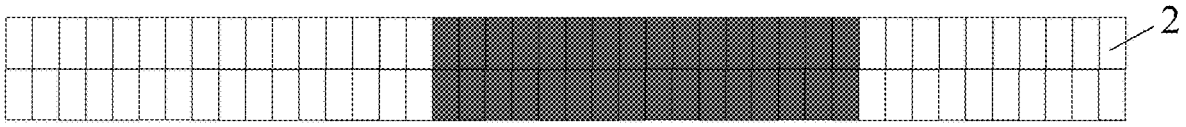
FIG. 22 is a schematic diagram of a typical picture in another reference picture according to an embodiment of the present disclosure.
Figure 23:
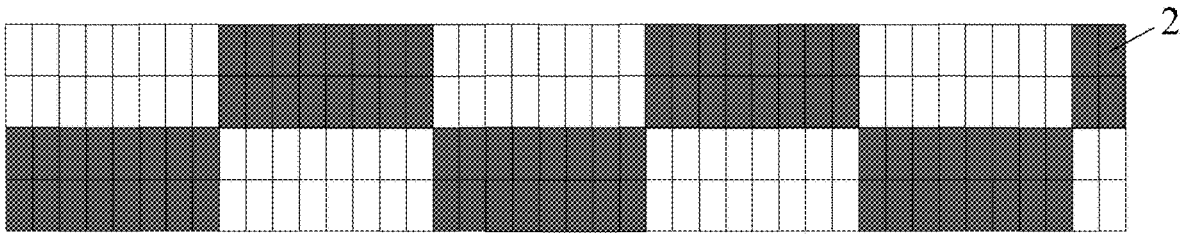
FIG. 23 is a schematic diagram of a typical picture in another reference picture according to an embodiment of the present disclosure.

In addition, for the display apparatus shown in FIG. 1 or FIG. 17 according to the embodiments of the present disclosure, there are still many typical pictures that are prone to problems. Those skilled in the art may adjust the embodiments of the present disclosure as needed without any creative efforts to obtain new implementation schemes. For example, the above-mentioned typical pictures are set as reference pictures or typical regions. These new implementation schemes should also fall within the protection scope of the embodiments of the present disclosure. For the convenience of understanding, FIG. 21 to FIG. 23 provide some examples of the above-mentioned typical pictures, which are used for reference rather than limit the embodiments of the present disclosure.

It is worth mentioning that the column direction, row direction, etc., mentioned in the exemplary embodiments of the present disclosure are only used for exemplary description, and can be understood as general settings by those skilled in the art according to the drawings of the description, that is, the column and row directions are set vertically to each other. However, the protection scope of the embodiments of the present disclosure is not limited thereto. For example, in a special-shaped (non-conventional rectangular) display apparatus, a first direction equivalent to the column direction and a second direction equivalent to the row direction may be adopted. The first direction and the second direction are not parallel.

The present disclosure further provides a display control apparatus 200, which may be applied to a display apparatus, for example, to any one of the display apparatuses 100 shown in FIG. 1 or FIG. 17 in the embodiments of the present disclosure. Alternatively, those skilled in the art may also apply the display control apparatus 200 to other display apparatuses according to requirements.

Figure 24:
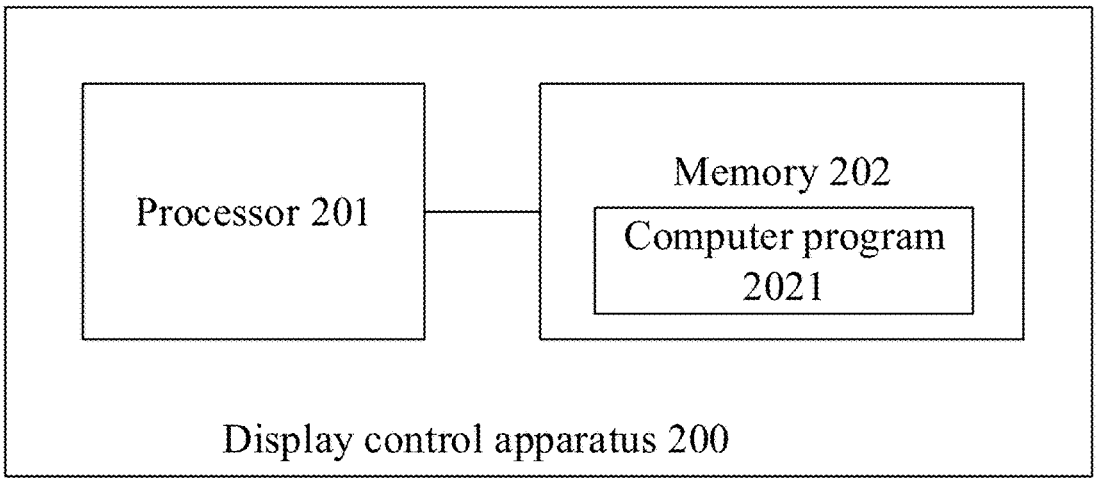
FIG. 24 is a schematic diagram of a display control apparatus according to an embodiment of the present disclosure.

As shown in FIG. 24, the display control apparatus 200 may include a processor 201, a memory 202, and a computer program 2021 stored in the memory 202 and executable on the processor 201. The processor 201 executes the computer program 2021 to implement: detecting a picture frame to be output; and controlling a plurality of data lines to output, in a first mode, data signals for displaying the picture frame to be output in response to detection that the picture frame to be output includes a reference picture, wherein a signal polarity sequence in the first mode is different from a signal polarity sequence in a second mode. The second mode is an output mode of the plurality of data lines when the picture frame to be output does not include a reference picture. The signal polarity sequence is a sequence of polarities of data signals provided by all of the plurality of data lines according to an arrangement order of the plurality of data lines in a display apparatus.

Optionally, in the first mode, the plurality of data lines is divided into a plurality of second data line groups arranged in sequence, each of the second data line groups includes y data lines, the y data lines in each of the second data line groups provide data signals of the same polarity in the same display frame, the data lines in adjacent second data line groups provide data signals of opposite polarities in the same display frame, and among the plurality of second data line groups, the numbers of data lines included in at least two of the second data line groups are different, where y is a non-zero natural number.

Optionally, in the first mode, according to an arrangement order of the plurality of second data line groups, the numbers of data lines included in the plurality of second data line groups satisfy the following rule: the $(5\times q+1)^{th}$ second data line group includes 1×m data lines; the $(5\times q+2)^{th}$ second data line group includes 2×m data lines; the $(5\times q+3)^{th}$ second data line group includes 2×m data lines; the $(5\times q+4)^{th}$ second data line group includes 2×m data lines; and the $(5\times q+5)^{th}$ second data line group includes 1×m data lines, where q is a natural number and m is a positive integer.

Optionally, in the first mode, according to an arrangement order of the plurality of second data line groups, the first second data line group includes 1×m data lines, other second data line groups each include 8×m data lines, and the other second data line groups are data line groups among the plurality of second data line groups except the first second data line group, where m is a positive integer.

Optionally, in the second mode, the plurality of data lines is divided into a plurality of first data line groups arranged in sequence, each of the first data line groups includes x data lines, the x data lines in each of the first data line groups provide data signals of the same polarity in the same display frame, data lines in adjacent data line groups provide data signals of opposite polarities in the same display frame, and the numbers of data lines included in the plurality of first data line groups are the same, where x is a non-zero natural number.

Optionally, the processor executes the computer program to implement: in the second mode and the first mode, controlling the polarities of data signals provided by the same data line to display frames adjacent in timing sequence to be opposite.

Optionally, the reference picture includes a characteristic region, and the characteristic region includes a plurality of image pixels arranged in an array. The plurality of image pixels is divided into a first image pixel group and a second image pixel group arranged next to each other. Grayscale values of image pixels in the first image pixel group are all greater than or equal to a first grayscale value, grayscale values of image pixels in the second image pixel group are all less than or equal to a second grayscale value, and the first grayscale value is greater than the second grayscale value. In addition, the first image pixel group and the second image pixel group each include image pixels presented by sub-pixels provided with an image signal by the same data line.

Optionally, when the display apparatus has a single-gate structure, the characteristic region includes image pixels presented by sub-pixels included in a first sub-pixel group and a second sub-pixel group in the $n^{th}$ row of sub-pixels and the $(n+1)^{th}$ row of sub-pixels. The first sub-pixel group includes 2x+1 columns of sub-pixels, the second sub-pixel group includes 2x+1 columns of sub-pixels, the image pixels presented by the sub-pixels in the first sub-pixel group form the first image pixel group, and the image pixels presented by the sub-pixels in the second sub-pixel group form the second image pixel group, where x is a natural number.

Optionally, when the display apparatus has a double-gate structure, the characteristic region includes image pixels presented by sub-pixels included in a first sub-pixel group and a second sub-pixel group in the $n^{th}$ row of sub-pixels and the $(n+1)^{th}$ row of sub-pixels. The first sub-pixel group includes 4x+2 columns of sub-pixels, and the second sub-pixel group includes 4x+2 columns of sub-pixels. The image pixels presented by the sub-pixels in the first sub-pixel group form the first image pixel group, and the image pixels presented by the sub-pixels in the second sub-pixel group form the second image pixel group, where x is a natural number.

Optionally, the reference picture includes a plurality of characteristic regions arranged in an array.

Optionally, the second grayscale value is zero.

Optionally, the processor executes the computer program to implement: receiving a user instruction, and determining a picture indicated by the user instruction as the reference picture.

Optionally, the processor executes the computer program to implement: controlling the plurality of data lines to output data signals in the second mode in response to detection that the picture frame to be output does not include the reference picture.

Optionally, the memory 202 is further configured to store information of the reference picture.

Furthermore, in the embodiments of the present disclosure, the display control apparatus may be a control chip independently integrated in the display apparatus, or may be integrated on a system on chip (SOC) or a graphics card of the display apparatus; or, the display control apparatus may be a timing controller (TCON) or a micro controller unit (MCU) integrated in the timing controller (TCON).

By adopting the display control apparatus 200 according to the embodiments of the present disclosure, output modules in different modes may be selected for a specific frame to be output, to reduce display failure caused by the overall or local fluctuations of the common voltage value.

The reference picture, the second mode, and the first mode of the display control apparatus 200 according to an embodiment of the present disclosure may adopt the same settings as that in the above-mentioned display control method of the present disclosure, and may also be adjusted appropriately as needed, which will not be repeated here.

The display control apparatus 200 provided in the present disclosure is not limited to two or three types, and the applicable scope of the embodiments of the present disclosure may be increased. For example, according to different rules, different output modules may be used for different specific pictures to adjust the output mode. It is conceivable for those skilled in the art, after understanding the idea of the present disclosure, to add or replace the output module without any creative effort within the scope disclosed in the embodiments of the present disclosure.

Figure 25:
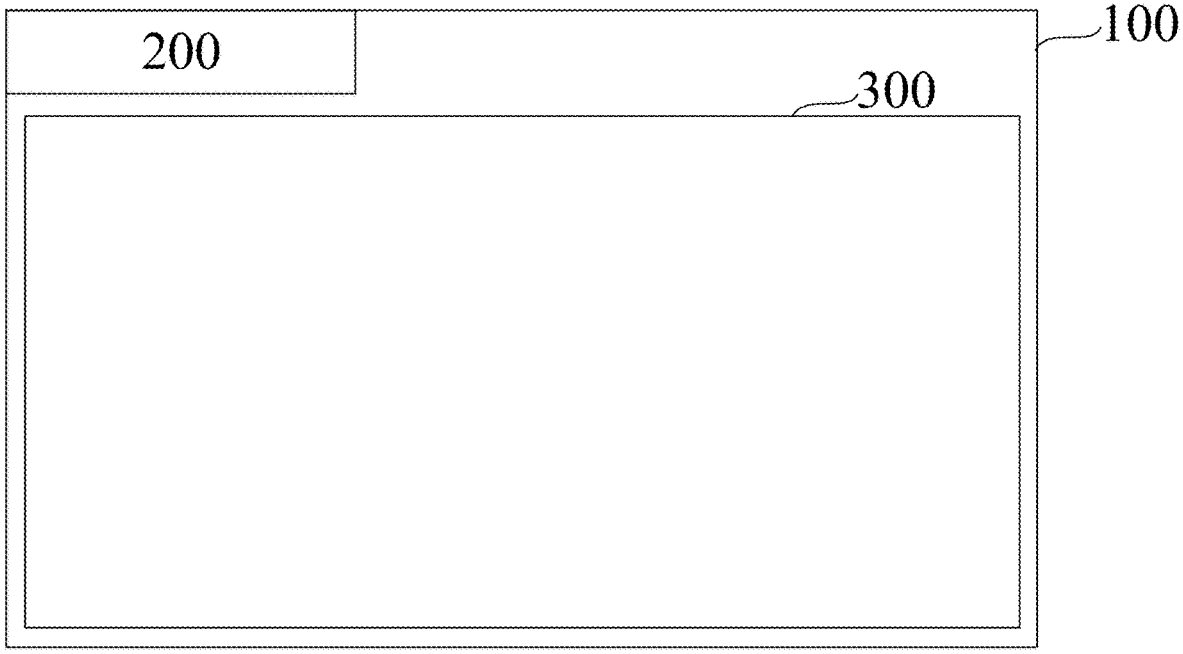
FIG. 25 is a schematic diagram of a display apparatus according to an embodiment of the present disclosure.

An embodiment of the present disclosure further provides a display apparatus 100. As shown in FIG. 25, the display apparatus 100 includes a display panel 300 and at least one display control apparatus 200 in the above embodiments.

For example, the display control apparatus 200 may include: a processor, a memory, and a computer program stored in the memory and executable on the processor. The processor executes the computer program to implement: detecting a picture frame to be output; and controlling a plurality of data lines to output, in a first mode, data signals for displaying the picture frame to be output in response to detection that the picture frame to be output includes a reference picture, wherein a signal polarity sequence in the first mode is different from a signal polarity sequence in a second mode. The second mode is an output mode of the plurality of data lines when the picture frame to be output does not include a reference picture, and the signal polarity sequence is a sequence of polarities of data signals provided by all of the plurality of data lines according to an arrangement order of the plurality of data lines in a display apparatus.

Optionally, the display panel includes a plurality of data lines sequentially arranged in a first direction and a plurality of gate lines sequentially arranged in a second direction. The plurality of data lines and the plurality of gate lines intersect to form a plurality of sub-pixels arranged in an array, each of the data lines alternately provides data signals to sub-pixels on two sides thereof, and the sub-pixels provided with data signals by each of the data lines are arranged in a zigzag pattern.

An embodiment of the present disclosure further provides a computer-readable storage medium which may be a non-volatile storage medium or a non-transitory storage medium and have stored therein a computer program. When executed by the processor, the computer program can implement any one of the foregoing display control methods.

For example, the computer program is executed by the processor to implement: detecting a picture frame to be output; and controlling a plurality of data lines to output, in a first mode, data signals for displaying the picture frame to be output in response to detection that the picture frame to be output includes a reference picture, wherein a signal polarity sequence in the first mode is different from a signal polarity sequence in a second mode. The second mode is an output mode of the plurality of data lines when the picture frame to be output does not include a reference picture, and the signal polarity sequence is a sequence of polarities of data signals provided by all of the plurality of data lines according to an arrangement order of the plurality of data lines in a display apparatus.

Optionally, the storage medium may include: various media that can store program codes, such as a read-only memory (ROM) or a random-access memory (RAM), a magnetic disk, or an optical disk.

An embodiment of the present disclosure further provides a computer device including a processor, a memory, and a computer program stored in the memory and executable on the processor. The processor can execute the computer program to implement any of the above display control methods.

For example, the processor executes the computer program to implement: detecting a picture frame to be output;

and controlling a plurality of data lines to output, in a first mode, data signals for displaying the picture frame to be output in in response to detection that the picture frame to be output includes a reference picture, wherein a signal polarity sequence in the first mode is different from a signal polarity sequence in a second mode. The second mode is an output mode of the plurality of data lines when the picture frame to be output does not include a reference picture, and the signal polarity sequence is a sequence of polarities of data signals provided by all of the plurality of data lines according to an arrangement order of the plurality of data lines in a display apparatus.

An embodiment of the present disclosure further provides a computer program product containing instructions. The computer program product, when running on a computer, enables the computer to implement any one of the display control methods described above.

For example, when the computer program product runs on the computer, the computer is enabled to implement: detecting a picture frame to be output; and controlling a plurality of data lines to output, in a first mode, data signals for displaying the picture frame to be output in response to detection that the picture frame to be output includes a reference picture, wherein a signal polarity sequence in the first mode is different from a signal polarity sequence in a second mode. The second mode is an output mode of the plurality of data lines when the picture frame to be output does not include a reference picture, and the signal polarity sequence is a sequence of polarities of data signals provided by all of the plurality of data lines according to an arrangement order of the plurality of data lines in a display apparatus.

Optionally, when the computer program product is loaded and executed on the computer, the processes or functions according to the embodiments of the present disclosure may be generated in whole or in part. The computer may be a general purpose computer, a special purpose computer, a computer network, or other programmable device. The computer program product may be stored in or transmitted through the computer-readable storage medium.

The memory may be a volatile memory, such as a random-access memory (RAM); the memory may also be a non-volatile memory, such as a flash memory, a hard disk drive (HDD) or a solid-state drive (SSD); and the memory may also be a combination of the above types of memories.

The processor may be a hardware chip for implementing the display control methods according to the present disclosure when executing the computer program. The hardware chip may be an application-specific integrated circuit (ASIC), a programmable logic device (PLD), or a combination thereof. The PLD may be a complex programmable logic device (CPLD), a field-programmable gate array (FPGA), a generic array logic (GAL), or any combination thereof. Alternatively, the processor may also be a general-purpose processor, for example, a central processing unit (CPU), a network processor (NP), or a combination of a CPU and an NP.

The above embodiments are merely exemplary implementations of the present disclosure, and the protection scope of the embodiments of the present disclosure is not limited thereto. Modifications, variations, and substitutions that can be easily derived by those skilled in the art within the scope disclosed in the embodiments of the present disclosure shall all be included in the protection scope of the embodiments of the present disclosure.

What is claimed is:

1. A display apparatus, comprising: a display panel and a display control apparatus, wherein the display control apparatus is configured to control a data line to output a data signal to the display panel to perform image display, and the display control apparatus comprises: a processor, a memory, and a computer program stored in the memory and executable by the processor, and the processor executes the computer program to implement:

detecting a picture frame to be output; and controlling a plurality of data lines to output, in a first mode, data signals for displaying the picture frame to be output in response to detection that the picture frame to be output comprises a reference picture, wherein the reference picture comprises a characteristic region, the characteristic region comprises a plurality of image pixels in an array, the plurality of image pixels is divided into a first image pixel group and a second image pixel group next to each other, grayscale values of image pixels in the first image pixel group are all greater than or equal to a first grayscale value, grayscale values of image pixels in the second image pixel group are all less than or equal to a second grayscale value, and the first grayscale value is greater than the second grayscale value; and the first image pixel group and the second image pixel group each comprise image pixels presented by sub-pixels provided with image signals by the same data line, and wherein a signal polarity sequence in the first mode is different from a signal polarity sequence in a second mode, the second mode is an output mode of the plurality of data lines when the picture frame to be output does not comprise the reference picture, the signal polarity sequence is a sequence of polarities of data signals provided by all of the plurality of data lines according to an arrangement order of the plurality of data lines in the display apparatus.

2. The display apparatus according to claim 1, wherein the display panel comprises: a plurality of data lines sequentially arranged in a first direction and a plurality of gate lines sequentially arranged in a second direction, the plurality of data lines and the plurality of gate lines intersect to form a plurality of sub-pixels in an array, each of the data lines alternately provides data signals to sub-pixels on two sides thereof, and sub-pixels provided with data signals by each of the data lines are arranged in a zigzag pattern.

3. A display control apparatus, comprising: a processor, a memory, and a computer program stored in the memory and executable by the processor, wherein the processor executes the computer program to implement:

detecting a picture frame to be output; and controlling a plurality of data lines to output, in a first mode, data signals for displaying the picture frame to be output in response to detection that the picture frame to be output comprises a reference picture, wherein the reference picture comprises a characteristic region, the characteristic region comprises a plurality of image pixels in an array, the plurality of image pixels is divided into a first image pixel group and a second image pixel group next to each other, grayscale values of image pixels in the first image pixel group are all greater than or equal to a first grayscale value, grayscale values of image pixels in the second image pixel group are all less than or equal to a second grayscale value, and the first grayscale value is greater than the second grayscale value; and the first image pixel group and the second image pixel group each comprise image pixels presented by sub-pixels provided with image signals by the same data line, and wherein a signal polarity sequence in the first mode is different from a signal polarity sequence in a second mode, the second mode is an output mode of the plurality of data lines when the picture frame to be output does not comprise the reference picture, the signal polarity sequence is a sequence of polarities of data signals provided by all of the plurality of data lines according to an arrangement order of the plurality of data lines in a display apparatus.

4. The display control apparatus according to claim 3, wherein in the first mode, the plurality of data lines is divided into a plurality of second data line groups arranged in sequence, each of the second data line groups comprises y data lines, the y data lines in each of the second data line groups provide data signals of the same polarity in a same display frame, data lines in adjacent second data line groups provide data signals of opposite polarities in a same display frame, where y is a non-zero natural number.

5. The display control apparatus according to claim 4, wherein, in the first mode, according to an arrangement order of the plurality of second data line groups, numbers of data lines in the plurality of second data line groups meet the following rule:

a $(5\times q+1)^{th}$ second data line group comprises 1×m data line(s);

a $(5\times q+2)^{th}$ second data line group comprises 2×m data lines;

a $(5\times q+3)^{th}$ second data line group comprises 2×m data lines;

a $(5\times q+4)^{th}$ second data line group comprises 2×m data lines; and a $(5\times q+5)^{th}$ second data line group comprises 1×m data line(s), where q is a natural number, and m is a positive integer.

6. The display control apparatus according to claim 4, wherein in the first mode, according to an arrangement order of the plurality of second data line groups, a first second data line group comprises 1×m data lines, and other second data line groups each comprise 8×m data lines, the other second data line groups being data line groups, except the first second data line group, among the plurality of second data line groups, where m is a positive integer.

7. The display control apparatus according to claim 3, wherein the processor executes the computer program to implement:

in the second mode and the first mode, controlling polarities of data signals provided by the same data line to display frames adjacent in timing sequence to be opposite.

8. The display control apparatus according to claim 3, wherein in the first mode, the plurality of data lines is divided into a plurality of second data line groups arranged in sequence, and among the plurality of second data line groups, numbers of data lines in at least two of the second data line groups are different.

9. A display control method, comprising:

detecting a picture frame to be output; and controlling a plurality of data lines to output, in a first mode, data signals for displaying the picture frame to be output in response to detection that the picture frame to be output comprises a reference picture, wherein the reference picture comprises a characteristic region, the characteristic region comprises a plurality of image pixels in an array, the plurality of image pixels is divided into a first image pixel group and a second image pixel group next to each other, grayscale values of image pixels in the first image pixel group are all greater than or equal to a first grayscale value, grayscale values of image pixels in the second image pixel group are all less than or equal to a second grayscale value, and the first grayscale value is greater than the second grayscale value; and the first image pixel group and the second image pixel group each comprise image pixels presented by sub-pixels provided with image signals by the same data line, and wherein a signal polarity sequence in the first mode is different from a signal polarity sequence in a second mode, the second mode is an output mode of the plurality of data lines when the picture frame to be output does not comprise the reference picture, and the signal polarity sequence is a sequence of polarities of data signals provided by all of the plurality of data lines according to an arrangement order of the plurality of data lines in a display apparatus.

10. The display control method according to claim 9, wherein in the first mode, the plurality of data lines is divided into a plurality of second data line groups arranged in sequence, each of the second data line groups comprises y data lines, the y data lines in each of the second data line groups provide data signals of the same polarity in a same display frame, data lines in adjacent second data line groups provide data signals of opposite polarities in a same display frame, where y is a non-zero natural number.

11. The display control method according to claim 10, wherein, in the first mode, according to an arrangement order of the plurality of second data line groups, numbers of data lines in the plurality of second data line groups meet the following rule:

a $(5\times q+1)^{th}$ second data line group comprises 1×m data line(s);

a $(5\times q+2)^{th}$ second data line group comprises 2×m data lines;

a $(5\times q+3)^{th}$ second data line group comprises 2×m data lines;

a $(5\times q+4)^{th}$ second data line group comprises 2×m data lines; and a $(5\times q+5)^{th}$ second data line group comprises 1×m data line(s), where q is a natural number, and m is a positive integer.

12. The display control method according to claim 10, wherein in the first mode, according to an arrangement order of the plurality of second data line groups, a first second data line group comprises 1×m data lines, and other second data line groups each comprise 8×m data lines, the other second data line groups being data line groups, except the first second data line group, among the plurality of second data line groups, where m is a positive integer.

13. The display control method according to claim 9, wherein in the second mode, the plurality of data lines is divided into a plurality of first data line groups arranged in sequence, each of the first data line groups comprises x data lines, the x data lines in each of the first data line groups provide data signals of the same polarity in a same display frame, data lines in adjacent first data line groups provide data signals of opposite polarities in a same display frame, and numbers of data lines in the plurality of first data line groups are the same, where x is a non-zero natural number.

14. The display control method according to claim 9, wherein in the second mode and the first mode, polarities of data signals provided by the same data line to display frames adjacent in timing sequence are opposite.

15. The display control method according to claim 9, wherein, when the display apparatus has a single-gate structure, the characteristic region comprises image pixels presented by sub-pixels in a first sub-pixel group and a second sub-pixel group in an nth row of sub-pixels and an (n+1)th row of sub-pixels, the first sub-pixel group comprises 2p+1 columns of sub-pixels, the second sub-pixel group comprises 2p+1 columns of sub-pixels, the image pixels presented by the sub-pixels in the first sub-pixel group form the first image pixel group, and the image pixels presented by the sub-pixels in the second sub-pixel group form the second image pixel group, where p is a natural number.

16. The display control method according to claim 9, wherein, when the display apparatus has a double-gate structure, the characteristic region comprises image pixels presented by sub-pixels in a first sub-pixel group and a second sub-pixel group in an nth row of sub-pixels and an (n+1)th row of sub-pixels, the first sub-pixel group comprises 4p+2 columns of sub-pixels, the second sub-pixel group comprises 4p+2 columns of sub-pixels, the image pixels presented by the sub-pixels in the first sub-pixel group form the first image pixel group, and the image pixels presented by the sub-pixels in the second sub-pixel group form the second image pixel group, where p is a natural number.

17. The display control method according to claim 9, wherein the reference picture comprises a plurality of characteristic regions in an array.

18. The display control method according to claim 9, further comprising:

receiving a user instruction, and determining a picture indicated by the user instruction as the reference picture.

19. The display control method according to claim 9, wherein in the first mode, the plurality of data lines is divided into a plurality of second data line groups arranged in sequence, and among the plurality of second data line groups, numbers of data lines in at least two of the second data line groups are different.

* * * * *